US012409978B2

(12) United States Patent
Porchia et al.

(10) Patent No.: US 12,409,978 B2
(45) Date of Patent: Sep. 9, 2025

(54) CLOSURE SYSTEM FOR POUCH OR CONTAINER

(71) Applicant: S. C. JOHNSON & SON, INC., Racine, WI (US)

(72) Inventors: Jose Porchia, Saginaw, MI (US); Jeramy M. Dubay, Hope, MI (US)

(73) Assignee: S. C. JOHNSON & SON, INC., Racine, WI (US)

( * ) Notice: Subject to any disclaimer, the term of this patent is extended or adjusted under 35 U.S.C. 154(b) by 82 days.

(21) Appl. No.: 18/134,450

(22) Filed: Apr. 13, 2023

(65) Prior Publication Data

US 2024/0343450 A1 Oct. 17, 2024

(51) Int. Cl.
*B65D 33/25* (2006.01)
*B65D 33/00* (2006.01)

(52) U.S. Cl.
CPC ..... *B65D 33/2541* (2013.01); *B65D 33/007* (2013.01)

(58) Field of Classification Search
CPC . B65D 33/2541; B65D 33/007; B65D 33/255
USPC ..... 383/63
See application file for complete search history.

(56) References Cited

U.S. PATENT DOCUMENTS 4,941,238 A 7/1990 Clark
5,070,584 A * 12/1991 Dais ..... B65D 33/255 24/585.12
5,138,750 A 8/1992 Gundlach et al.
5,140,727 A 8/1992 Dais et al.
5,509,734 A 4/1996 Ausnit
5,647,100 A * 7/1997 Porchia ..... B65D 33/2558 24/585.12
5,962,040 A * 10/1999 Dais ..... B65D 33/255 425/290

(Continued)

FOREIGN PATENT DOCUMENTS

EP 0510797 A1 10/1992
JP 2004026193 A 1/2004

(Continued)

OTHER PUBLICATIONS

Machine translation of JP 2018008728 A (Year: 2020).*
PCT International Search Report and Written Opinion, Application No. PCT/US2024/023848, Aug. 28, 2024, 14 pages.

*Primary Examiner* — Jes F Pascua
(74) *Attorney, Agent, or Firm* — Quarles & Brady LLP

(57) ABSTRACT

A container made entirely from an elastomer includes a body with a front wall and a rear wall that is connected to the front wall along a peripheral edge. The container further includes a closure system comprising a front side having a male closure profile that includes a male closure element and a rear side having a female closure profile. The female closure profile includes a female closure element and defines a cavity. A centerline extends through the cavity such that the female closure element is symmetrical about the centerline. The male closure element includes a head portion that has a primary profile and a secondary profile that extends from the primary profile. A height of the secondary profile measured in a direction that is perpendicular to the centerline is greater than a height of the primary profile measured in a direction that is perpendicular to the centerline.

21 Claims, 21 Drawing Sheets

(56) References Cited

U.S. PATENT DOCUMENTS

| | | | |
|---|---|---|---|
| 5,988,880 | A | 11/1999 | Tomic |
| 6,185,796 | B1 | 2/2001 | Ausnit |
| 6,234,676 | B1 | 5/2001 | Galomb et al. |
| 6,953,542 | B2 | 10/2005 | Cisek |
| 7,189,001 | B2 | 3/2007 | Gerrits |
| 7,270,479 | B2 | 9/2007 | Nelson |
| 7,857,515 | B2 | 12/2010 | Dais et al. |
| 8,469,593 | B2 | 6/2013 | Price et al. |
| 8,827,556 | B2 | 9/2014 | Dais et al. |
| 9,371,153 | B1 | 6/2016 | Nouri et al. |
| 10,618,697 | B2 | 4/2020 | Price et al. |
| 11,084,628 | B2 | 8/2021 | Finell et al. |
| 11,097,505 | B2 | 8/2021 | Denis et al. |
| 11,104,487 | B2 | 8/2021 | Septien Rojas et al. |
| RE48,721 | E | 9/2021 | Nouri et al. |
| 11,180,286 | B2 | 11/2021 | Pawloski |
| 11,358,755 | B2 | 6/2022 | Finell et al. |
| 11,383,890 | B2 | 7/2022 | Finell et al. |
| 11,505,368 | B2 | 11/2022 | Woo et al. |
| 2003/0223654 | A1 | 12/2003 | Gerrits |
| 2008/0240625 | A1 | 10/2008 | McCracken et al. |
| 2011/0069911 | A1 | 3/2011 | Ackerman et al. |
| 2012/0106874 | A1 | 5/2012 | Pawloski |
| 2015/0049962 | A1* | 2/2015 | Bois ..... B65D 33/25 383/63 |
| 2018/0184767 | A1 | 7/2018 | Oike et al. |
| 2020/0239194 | A1 | 7/2020 | Yosufy |
| 2021/0214129 | A1 | 7/2021 | Woo et al. |
| 2021/0323731 | A1 | 10/2021 | Finell et al. |
| 2022/0402658 | A1 | 12/2022 | DeCarlo et al. |

FOREIGN PATENT DOCUMENTS

| | | | | |
|---|---|---|---|---|
| JP | 2018008728 | A | * | 1/2018 |
| KR | 200491587 | Y1 | * | 5/2020 |
| WO | 2009090674 | A2 | | 7/2009 |
| WO | 2020240448 | A1 | | 12/2020 |
| WO | 2020240449 | A1 | | 12/2020 |
| WO | 2020240450 | A1 | | 12/2020 |

* cited by examiner

CLOSURE SYSTEM FOR POUCH OR CONTAINER

BACKGROUND OF THE DISCLOSURE

1. Field of the Disclosure

The present disclosure generally relates to pouches or containers comprising an improved closure system, and more particularly to closure systems that create a desirable sound for the user during closure.

2. Description of the Background of the Disclosure

Historically, re-closeable pouches and containers (collectively "bags") that are used in food packaging comprise a folded web of elastomeric material, or a web formed of blown, cast, monolayer, or co-extruded films, and have two side walls that are folded at the bottom and sealed at the sides. The bags typically have a re-closable fastener or closure system at a top of the bag, such as, for example, an adhesive, a wire tie, or a plastic zipper. While thermoplastic bags have a variety of benefits, including reduced cost and ease of manufacture, efficient packaging and transport, and desirable sealing capabilities for end use, such bags are typically not re-usable, and given consumer trends related to re-usable packaging, new and improved food packaging bags are desired that maintain the benefits associated with prior art bags. It is therefore desirable to maintain or enhance the benefits of prior art bags through the use of materials that provide for repeated use, i.e., by using one or more sustainable materials.

Sealable bags that are also re-usable are known in the art. For example, elastomeric pouches having re-sealable closure mechanisms applied longitudinally across a mouth thereof that allow repeated opening and closing of the pouch are known in the art. While elastomeric bags are becoming more desirable because of consumer demand for re-usable bags, these types of bags have different physical properties than existing thermoplastic bags, which requires different sealing mechanisms and considerations.

While the technology associated with the sealing mechanisms of existing thermoplastic bags has been developed over at least the last 70 years, the technology for sealing thermoplastic bags is not directly transferable to the requirements of elastomeric bags. This is especially so since some elastomeric bags may be used during cooking and may be exposed to extremes in temperature, pressure, and/or otherwise required to deal with various forces on the bag walls not typically contemplated with thermoplastic bags.

While improvements have been made to prior art sealing systems to provide for enhanced seals, such seals generally involve complicated structures, which can lead to increased complexity when manufacturing and using such sealing systems. Such sealing structures can include multiple pairs of opposing, interlocking closure profiles, which can be difficult to seal and/or can cause a user consternation in not knowing whether the multiple pairs of interlocking closure profiles have been properly sealed. These types of seals used with thermoplastic bags are not practical or directly transferrable to seals for elastomeric, re-usable bags. It is therefore desirable to provide a re-closable closure mechanism for an elastomeric pouch that includes a simpler sealing structure that is capable of providing an air-tight or water-tight seal, and that can be used in more rigorous applications.

Further, prior art bags that are formed with elastomeric materials typically do not include additional structure that provide enhanced auditory/tactile feedback when opening/closing the bag. In particular, deficiencies remain in that a user cannot be sure that the zipper is properly closed to seal the bag. While some prior art containers do include sealing structures that provide enhanced sealing qualities, such designs do not provide for an easily identifiable auditory/tactile cue to a user that the bag has been opened or closed. For example, although the zipper may produce an audible sound, the sound may not be easily heard or recognized as closing the bag by the user.

Therefore, a need exists for re-usable pouches or containers that alleviate one or more of the problems associated with, or particular to, existing containers and pouches.

SUMMARY OF THE DISCLOSURE

The present disclosure provides for an enhanced closure system made entirely from an elastomer that includes a sealing structure that provides unique auditory/tactile feedback to a user during opening or closing a container or pouch. In some embodiments, a container or pouch made entirely from an elastomer includes a body that comprises a front wall and a rear wall that is connected to the front wall along a peripheral edge. The container or pouch further includes a closure system comprising a front side having a male closure profile that includes a male closure element and a rear side having a female closure profile. The female closure profile includes a female closure element and defines a cavity. A centerline extends through the cavity such that the female closure element is symmetrical about the centerline. The male closure element includes a head portion that has a continuous, primary profile and a non-continuous, secondary profile that extends from the primary profile. A height of the secondary profile measured in a direction that is perpendicular to the centerline is greater than a height of the primary profile measured in a direction that is perpendicular to the centerline.

According to some embodiments, a container or pouch made entirely from an elastomer includes a body that comprises a front wall and a rear wall that is connected to the front wall along a peripheral edge. The container or pouch further includes a closure system comprising a front side having a male closure profile that includes a male closure element and a rear side having a female closure profile. The female closure profile includes a female closure element and defines a cavity. A centerline extends through the cavity such that the female closure element is symmetrical about the centerline. The male closure element includes a head portion that has a continuous, primary profile and a non-continuous, secondary profile that extends from the primary profile. A height of the secondary profile measured in a direction that is perpendicular to the centerline is greater than a height of the cavity measured in a direction that is perpendicular to the centerline.

According to some embodiments, a container or pouch made entirely from an elastomer includes a body that comprises a front wall and a rear wall that is connected to the front wall along a peripheral edge. The container or pouch further includes a closure system comprising a front side having a male closure profile that includes a male closure element and a rear side having a female closure profile. The female closure profile includes a female closure element and defines a cavity and an opening. A longitudinal plane extends through the peripheral edge, and a centerline extends through the cavity such that the female closure element is symmetrical about the centerline. The male closure element includes a head portion that has a continuous, primary profile that defines thin regions of the male closure element and a non-continuous, secondary profile that extends from the primary profile and defines oversized regions of the male closure element. A length of a single thin region of the male closure element measured in a direction parallel to the longitudinal plane is between 1% and 10% of a length of the male closure element measured in a direction parallel to the longitudinal plane, and a length of a single oversized region of the male closure element measured in a direction parallel to the longitudinal plane is between 1% and 10% of the length of the male closure element.

BRIEF DESCRIPTION OF THE DRAWINGS

Other aspects and advantages of the present disclosure will become apparent upon consideration of the following detailed description, wherein similar structures have similar reference numerals.

DETAILED DESCRIPTION

Figure 2:
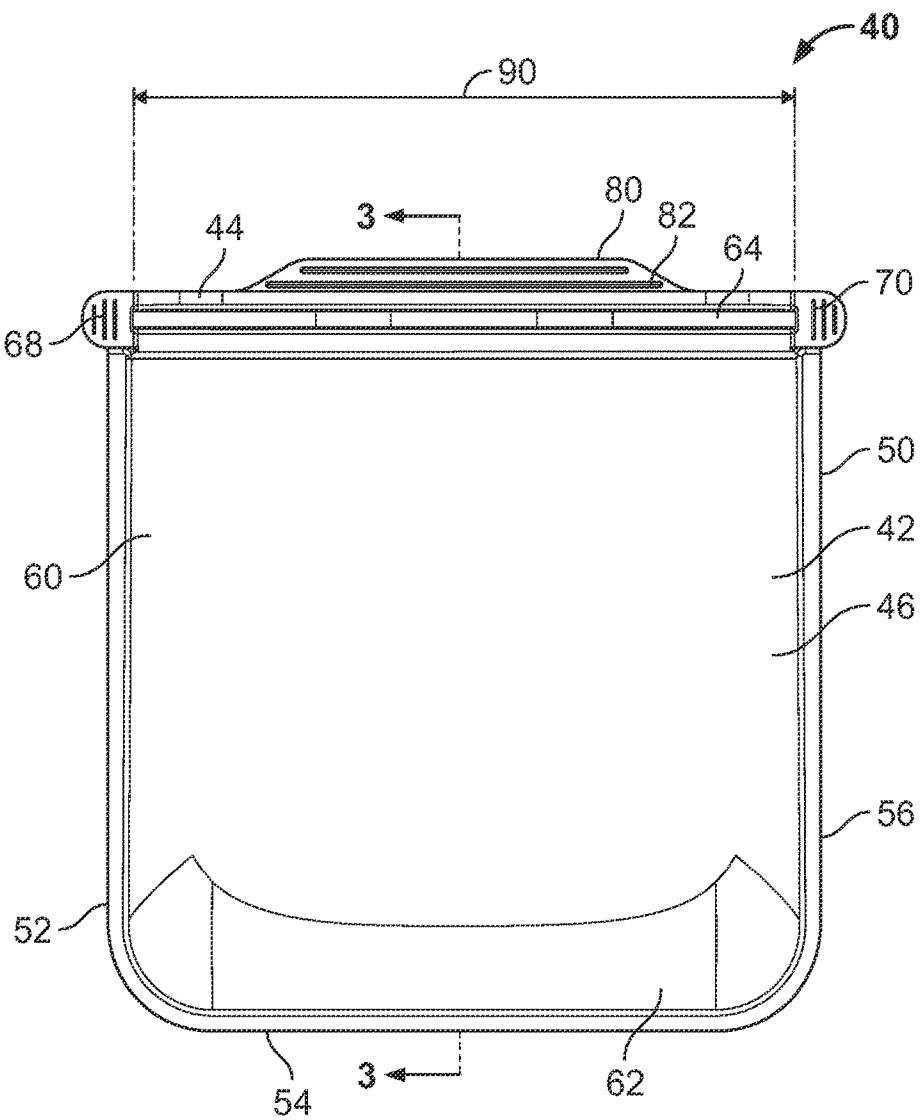
FIG. 2 is a front elevational view of the pouch of FIG. 1.

The present disclosure is directed to pouches and containers comprising an improved closure system, and more particularly to closure systems that create a desirable sound for the user during closure. While the systems disclosed herein may be embodied in many different forms, several specific embodiments are discussed herein with the understanding that the embodiments described in the present disclosure are to be considered only exemplifications of the principles described herein, and the disclosure is not intended to be limited to the embodiments illustrated. Throughout the disclosure, the terms "about" and "approximate" mean plus or minus 5% of the number or value that each term precedes. As used herein, the phrase "elastomer" refers to a material which at room temperature can be stretched repeatedly and, upon immediate release of the stress, will return with force to its approximate original length. Further, the phrase "leak resistant seal" refers to a seal that resists leakage of liquids and solids from the container during storage and transport without the aid of an external structure to maintain the seal. Finally, the term "closure element" is defined herein to mean one part of a closure. For example, on a zipper closure, a closure element is one profile or the other of the zipper, e.g., a rib profile or a groove profile.

The present disclosure is related to storage pouches and containers that include improved zipper designs. The pouches and zipper designs may take varying forms, and representative examples are provided in FIGS. 1-10D. While the embodiments disclosed herein are formed entirely by an elastomer, such as silicone, it is contemplated that multiple components may be coupled or formed together to achieve the embodiments disclosed herein. While varying manufacturing methods may be used, the pouches and containers disclosed herein may be manufactured using a Liquid Injection Mold Process (LIM process) through which the entire pouch or container is molded in one piece and is made of silicone. Alternative methods of manufacture may be implemented, such as compression molding, transfer molding, extrusion, blow molding, sheet extrusion, and thermal forming.

Closure elements of the present technology include a plurality of intermittent or alternating digitations of differing shape along one or both of the profiles, but preferably have intermittent or alternating segments of two different profiles as in the embodiments illustrated herein. The segments of differing shape may be of equal or unequal length.

Referring now to FIGS. 1-4, a re-closable pouch 40 is shown that includes a body 42 and a closure system 44, as disclosed herein. The pouch 40 may be entirely made of one or more elastomeric materials, and may comprise one or more of an unsaturated rubber, a saturated rubber, or a thermoplastic elastomer (TPE), among other elastomeric materials. When the pouch 40 is molded as a unitary component, leak paths along edges of the pouch 40 are minimized or eliminated since no additional sealing is required along the various edges of the pouch 40, in contrast to many prior art plastic zippered bags. By forming the pouch 40 as a unitary component, the structural integrity of the pouch 40 is enhanced. Since the entire pouch 40 is constructed of an elastomer, the pouch 40 is considered to be a long-life container.

Figure 1:
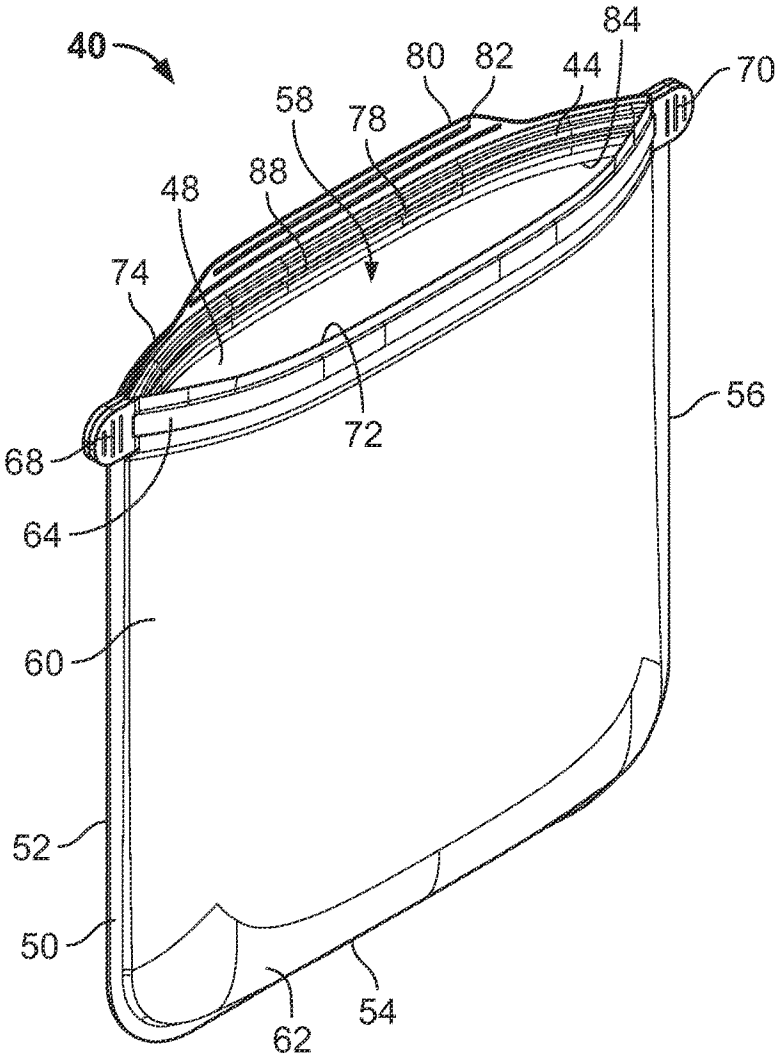
FIG. 1 is an isometric view of a pouch having a closure system as disclosed herein, and shown in an open configuration.
Figure 4:
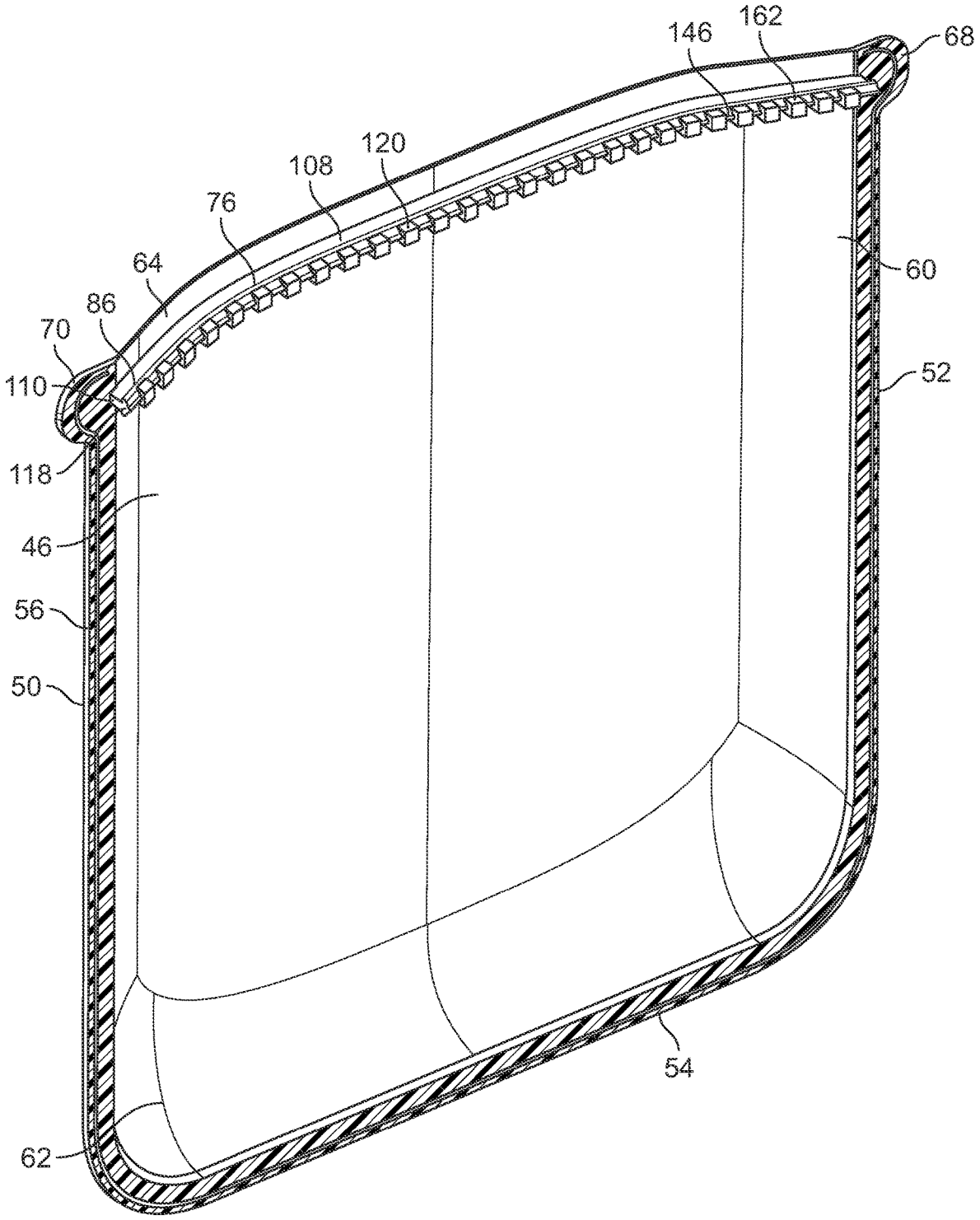
FIG. 4 is a partial isometric cross-sectional view of the pouch taken through line 4-4 of FIG. 3.

Referring to FIGS. 1 and 2, the body 42 is defined by a first or front wall 46 having a width and a second or rear wall 48, which are joined together along a seam or peripheral edge 50 that extends along a first or left side 52, a second or bottom side 54, and a third or right side 56 of the body 42. While the body 42 of the present embodiment is a unitary component, in some embodiments, the front wall 46 and the rear wall 48 may be connected by, for example, folding, heat sealing, and/or an adhesive, along the peripheral edge 50. A receptacle 58 is defined between the front wall 46 and the rear wall 48 of the body 42, which is configured for holding and retaining food or other material(s) that are placed into the receptacle 58 for storage therein. Referring to the cross-sectional view of FIG. 4 showing the pouch 40 in an open configuration, upper portions 60 of the front wall 46 and the rear wall 48 are generally straight, while lower portions 62 of the front wall 46 and the rear wall 48 are curved and join one another at the peripheral edge 50 along the bottom side 54 of the body 42. However, in alternative embodiments, the upper portions 60 need not be straight, and the lower portions 62 need not be curved. It should be appreciated that due to the use of an elastomer to form the front wall 46 and the rear wall 48, gravity will cause the walls 46, 48 to deform or curve when the pouch 40 is placed on a resting surface (not shown).

Still referring to FIG. 1, the re-closeable pouch 40 further includes the closure system 44, which extends upwardly from the body 42. The closure system 44 includes a first or front side 64, a second or rear side 66, a first or left tab 68, and a second or right tab 70. The front side 64 comprises a front sealing strip 72 that extends longitudinally across the pouch 40, and the rear side 66 comprises a rear sealing strip 74 that also extends longitudinally across the pouch 40. The front sealing strip 72 and the rear sealing strip 74 define a closure mechanism, which includes a first or male closure profile 76 (see FIG. 3) defined by the front sealing strip 72, and a second or female closure profile 78 defined by the rear sealing strip 74. The front sealing strip 72 and the rear sealing strip 74 comprise the male closure profile 76 and the female closure profile 78, respectively, and further include various base regions of the front side 64 and the rear side 66 of the closure system 44, respectively, as discussed below. Further, a handle or lip 80 is further disposed on the rear side 66, which defines a generally trapezoidal extension that extends upward from the rear sealing strip 74. The lip 80 includes a plurality of longitudinal ribs 82 disposed horizontally therealong that may assist with allowing a user to grip the lip 80 to open the pouch 40 (see FIG. 2). The ribs 82 may be in the form of protrusions that extend outward from the lip 80, or grooves that extend into or through the lip 80.

Figure 3:
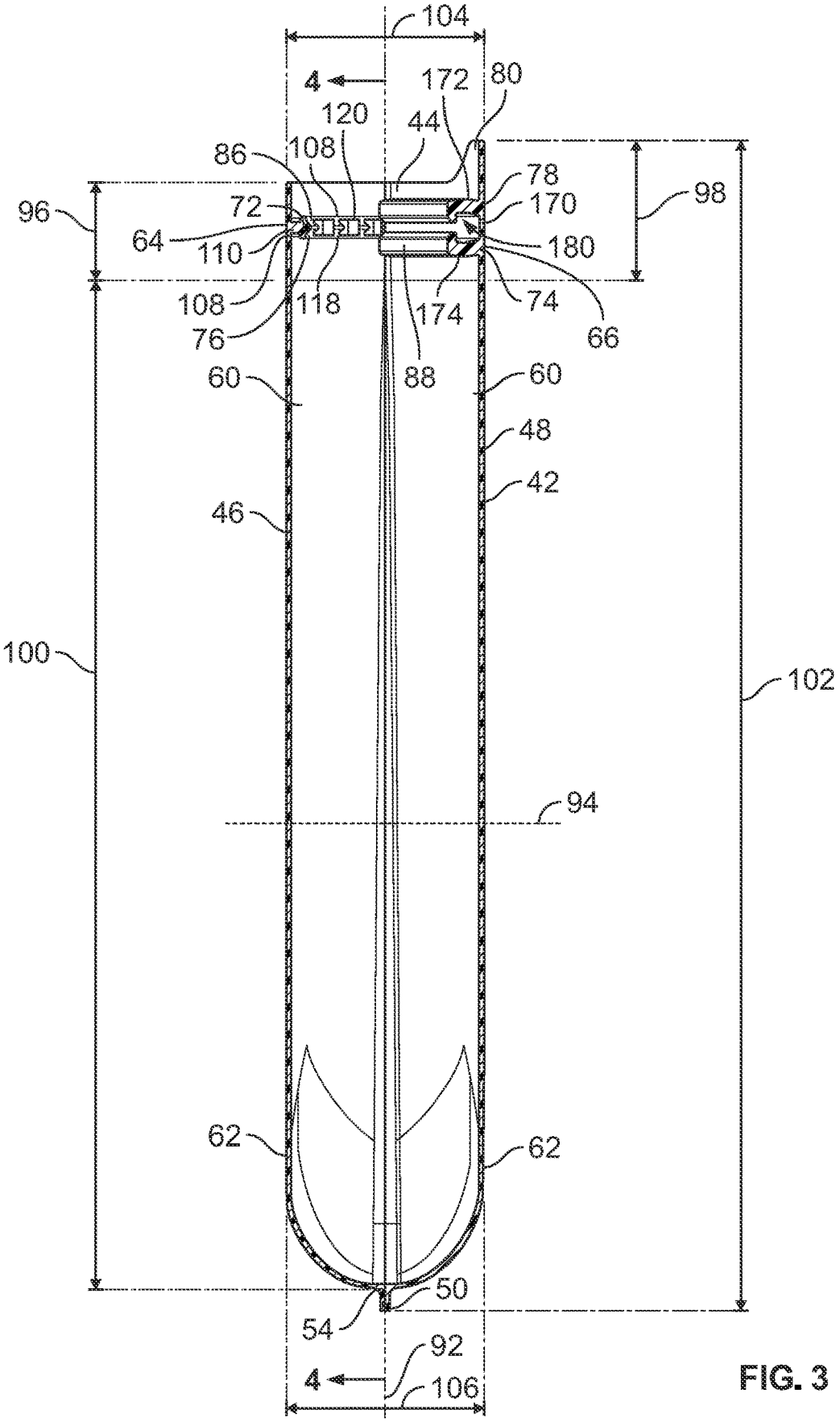
FIG. 3 is a side cross-sectional view of the pouch taken through line 3-3 of FIG. 2.

Referring now to FIG. 3, the male closure profile 76 is disposed on the front side 64 of the closure system 44, and the female closure profile 78 is disposed on the rear side 66 of the closure system 44, thus, the male closure profile 76 and the female closure profile 78 extend along opposing portions of an inner side 84 of the closure system 44. As shown, the male closure profile 76 includes a male closure element 86 and the female closure profile 78 includes a female closure element 88 that are each unitary with the front side 64 and the rear side 66 of the closure system 44. The male closure element 86 and the female closure element 88 extend inwardly along a length 90 (see FIG. 2) defined between the right tab 70 and the left tab 68. The male closure element 86 and the female closure element 88 are aligned with respect to one another. Particular aspects of the male closure profile 76 and the female closure profile 78 are discussed in greater detail with respect to the embodiments discussed and shown in FIGS. 5A-10D.

Still referring to FIG. 3, the pouch 40 defines a longitudinal axis or plane 92 that extends through the peripheral edge 50, and a horizontal axis or plane 94 that extends orthogonally through the longitudinal plane 92. Various dimensions of the pouch 40 are shown, including the length 90 of the closure system 44 measured in a direction perpendicular to the longitudinal plane 92 (see FIG. 2), a height 96 of the front side 64 of the closure system 44, a height 98 of the rear side 66 of the closure system 44, a height 100 of the body 42, and a height 102 of the pouch 40. Each of the heights 96, 98, 100, 102 are measured along lines that are parallel with respect to the longitudinal plane 92. A width 104 of the closure system 44 and a width 106 of the body 42 are shown, which each define a widest measurement of the closure system 44 and body 42, respectively. While the widths 104, 106 are illustrated at a widest point of the pouch 40, thus, defining a widest width of the pouch 40 in an open configuration, the term "width" is to be construed as a width taken at any point along each respective element of the pouch 40.

While the body 42 and the closure system 44 of the pouch 40 have varying heights 96, 98, 100, 102 and widths 104, 106, these differences relate to the particular capacity of the receptacle 58 and profile of the pouch 40, and the desired amount of food or other material(s) that can be placed into the receptacle 58. However, the various dimensional relationships between the body 42 and the closure system 44 of the pouch 40 may vary within the following ranges. Further, while the pouch 40 is shown without a flat bottom wall, it is contemplated that the pouch 40 may be another type of container that includes additional walls, such as a bottom wall, that would allow the pouch 40 to rest upon a resting surface without additional components to assist therewith.

Still referring to FIG. 3, the height 96 may be between about 50% and about 95%, between about 60% and about 85%, or between about 70% and about 80% of the height 98 of the rear side 66 of the closure system 44. In some embodiments, the height 96 of the front side 64 of the closure system 44 may be between about 5% and about 30%, between about 10% and about 25%, or between about 10% and about 15% of the height 100 of the body 42. The height 96 of the front side 64 may be between about 2% and about 30%, between about 5% and about 25%, or between about 5% and about 15% of the height 102 of the pouch 40. The width 104 of the closure system 44 may be between about 100% and about 140%, between about 110% and about 130%, or between about 115% and about 120% of the width 106 of the body 42.

Figure 5B:
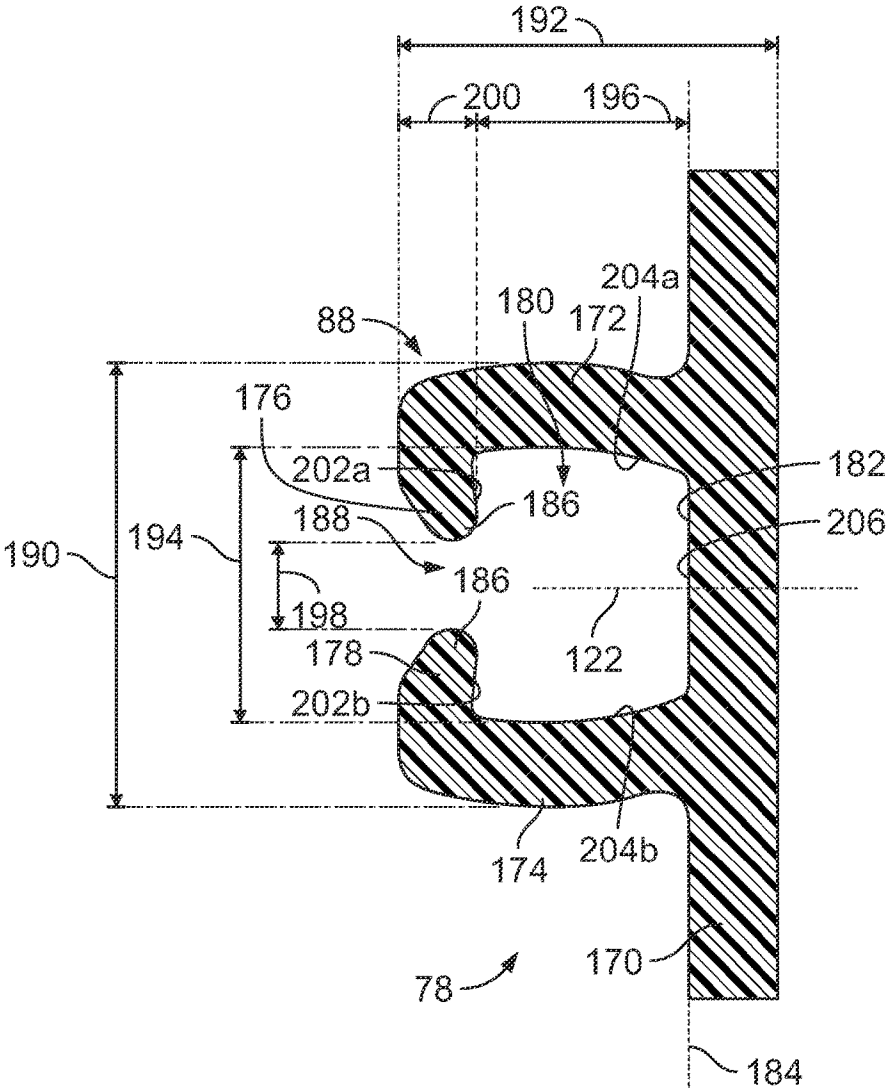
FIG. 5B is a detail view of a female closure profile of the closure system of FIGS. 1-4, according to some aspects of the present disclosure.
Figure 5A:
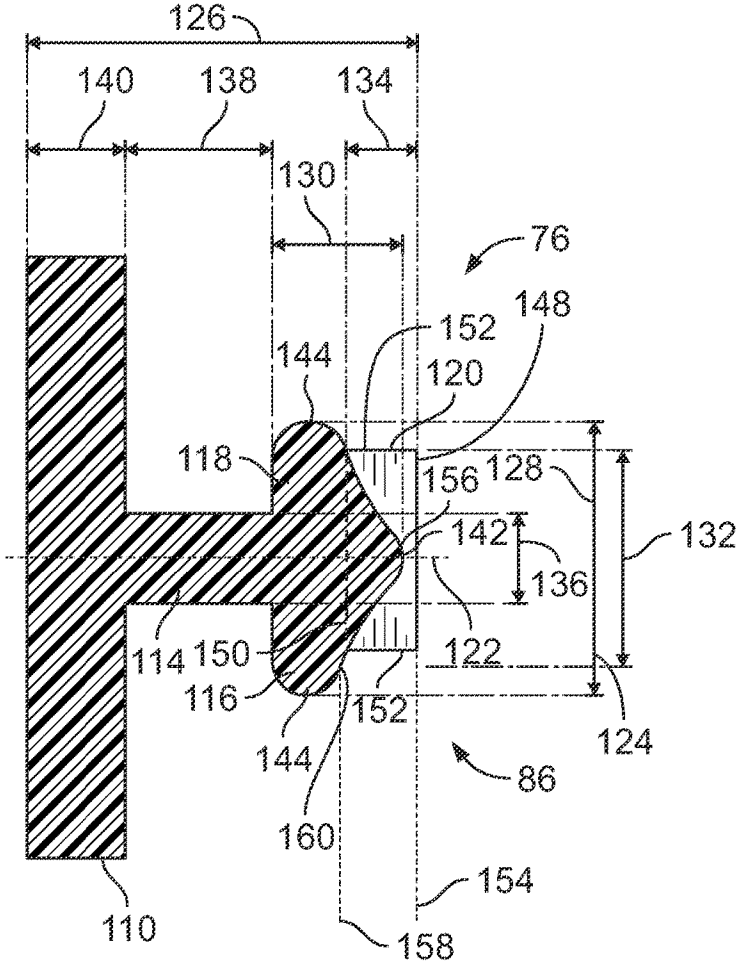
FIG. 5A is a detail view of a male closure profile of the closure system of FIGS. 1-4, according to some aspects of the present disclosure.

Referring now to FIG. 5A, a detail view is shown of a first example of the male closure profile 76 of FIGS. 1-4. The male closure profile 76 includes the male closure element 86 and a base region 110. The male closure element 86 comprises a stem 114 that extends outward from the base region 110 and joins a head portion 116. The head portion 116 includes alternating segments of different shapes or profiles, but preferably has alternating segments of two differently shaped profiles such as an arrow-shaped or primary profile 118 and an oversized or secondary profile 120. The male closure element 86 is symmetric about a longitudinal center plane or centerline 122; however, alternative asymmetric embodiments are contemplated as will be further discussed herein. In some aspects, the secondary profile 120 of the head portion 116 defines discrete interdigitations along the male closure strip 108, and the secondary profile 120 is molded over or extends from the primary profile 118 such that the primary profile 118 and the secondary profile 120 are molded as unitary components with one another, the stem 114, and the base region 110. The male closure element 86 defines a height 124 and a thickness 126, the primary profile 118 of the male closure element 86 defines a height 128 and a thickness 130, the secondary profile 120 of the male closure element 86 defines a height 132 and a thickness 134, the stem 114 defines a height 136 and a thickness 138, and the base region 110 defines a thickness 140.

The primary profile 118 further defines an outer corner 142 and inner corners 144 that are disposed in a triangular configuration, and the primary profile 118 and the stem 114 are molded as unitary components with the base region 110. In some aspects, the primary profile 118 extends continuously along the male closure strip 108 (see FIG. 4). Thin regions 146 (see FIG. 4) of the male closure strip 108 are defined as discrete regions that do not include the interdigitations defined by the secondary profile 120, i.e., regions in which the head portion 116 is defined only by the primary profile 118.

In some aspects, the secondary profile 120 of the head portion 116 defines a rectangular profile, although it is contemplated that other configurations or shapes can be used for the secondary profile 120 as will be discussed for FIGS. 6A-10D. In the embodiment illustrated in FIG. 5A, the secondary profile 120 is defined by an outward face 148, side faces 152, and an inward face 150 (see FIGS. 7A, 8A, 9A, 10A) such that the side faces 152 connect the outward face 148 with the inward face 150. The outward face 148 is defined by a first vertical line or plane 154 that extends in a direction that is perpendicular with respect to the centerline 122 and through an outermost point 156 along the outer corner 142 of the primary profile 118. The outward face 148 extends between the side faces 152 along the vertical plane 154, and the height 132 of the secondary profile 120 is measured in a direction perpendicular with respect to the centerline 122 and along the outward face 148. The thickness 134 of the secondary profile 120 is measured in a direction parallel with respect to the centerline 122 and inward from the outward face 148 to the inward face 150, the inward face 150 defined by a second vertical plane 158 that extends in a direction that is parallel with respect to the first vertical plane 154 and through a point 160 in the primary profile 118. The side faces 152 extend between the outward face 148 and the inward face 150. The secondary profile 120 is molded over or extends from the primary profile 118 to define an oversized region 162 of the male closure element 86. In this way, the inward face 150 is entirely defined by the primary profile 118 such that only the side faces 152 and the outward face 148 are visible.

Still referring to FIG. 5A, the height 128 of the primary profile 118 is greater than the height 136 of the stem 114. In some embodiments, the thickness 140 of the base region 110 is between about 10% and about 60%, between about 20% and about 50%, at least about 10%, at least about 20%, at least about 30%, at least about 40%, or at least about 50% of the thickness 126 of the male closure element 86. In some aspects, the height of the secondary profile 120 is between about 50% and about 300%, between about 100% and about 200%, between about 125% and about 175%, between about 175% and about 200%, between about 50% and about 100%, between about 50% and about 60%, between about 60% and about 70%, or between about 70% and about 80% of the height 128 of the primary profile 118. In some embodiments, the thickness 134 of the secondary profile 120 is between about 25% and about 125%, between about 25% and about 75%, between about 40% and about 60%, between about 60% and about 70%, between about 80% and about 90%, or between about 90% and about 100% of the thickness 130 of the primary profile 118.

Figure 5C:
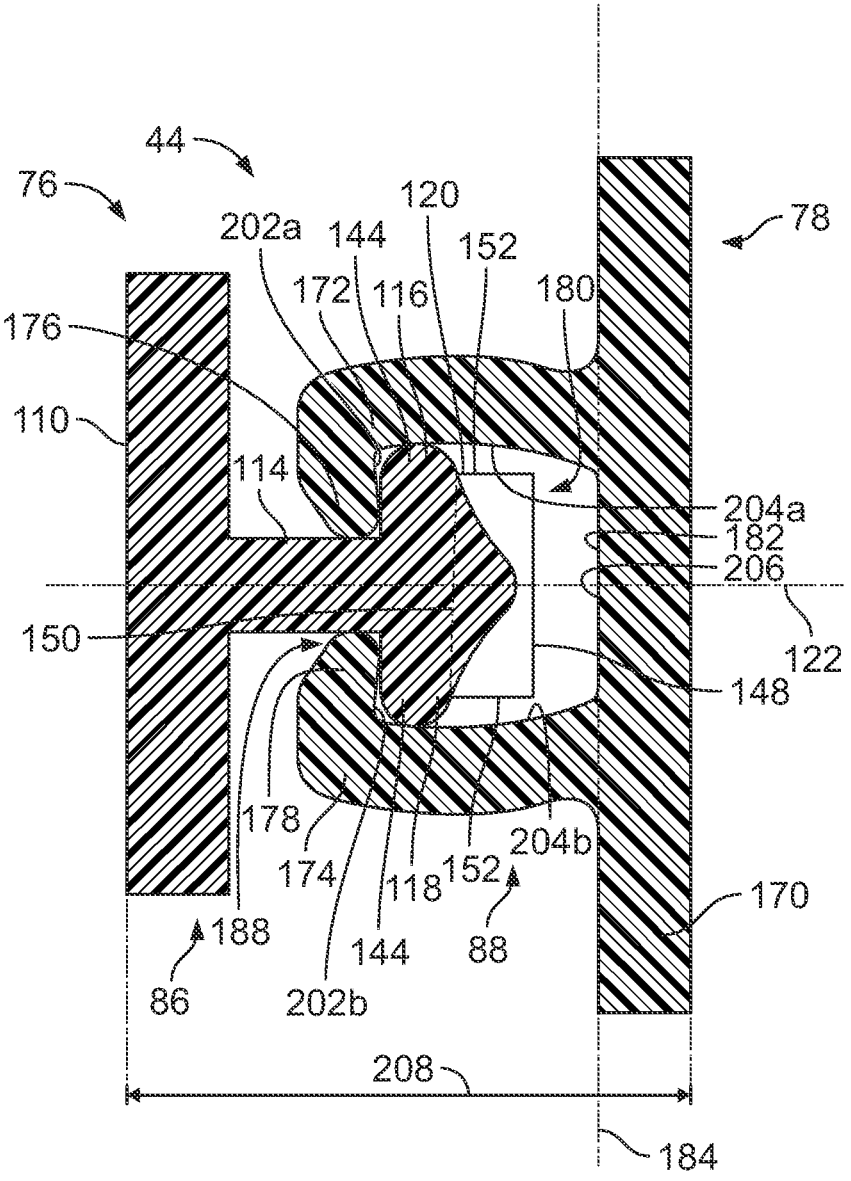
FIG. 5C is a detail view of the male and female closure profiles of FIGS. 5A and 5B in a closed configuration.
Figure 5D:
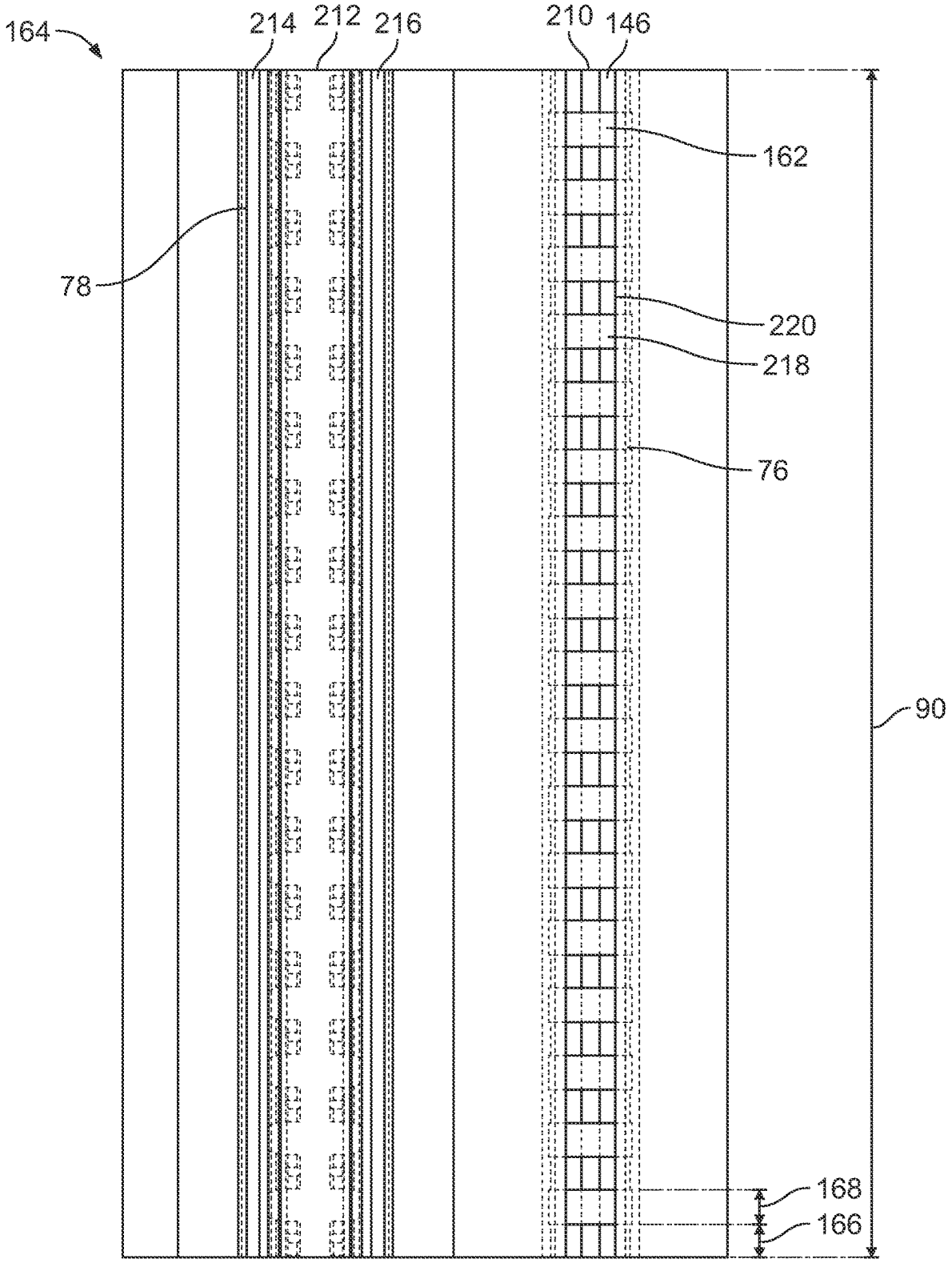
FIG. 5D is a top view of a mold used to manufacture the male and female closure profiles of FIGS. 5A-5C.

Referring now to FIG. 5D, a top view is illustrated of a mold 164 used to form the closure mechanism. To provide desired auditory/tactile feedback during use of the closure mechanism, oversized regions 162 are spaced from one another along the length of the portion of the mold 164 that is associated with forming the male closure element 86. A single thin region 146 defines a length 166 measured parallel with respect to the longitudinal plane 92 (see FIG. 5A), and a single oversized region 162 defines a length 168 measured parallel with respect to the longitudinal plane 92 (see FIG. 5A). In some aspects, the length 168 is between about 25% and about 400%, between about 50% and about 200%, between about 75% and about 150%, between about 90% and about 110%, or about 100% of the length 166 of a single thin region 146. In some aspects, the length 168 of a single oversized region 162 and/or the length 166 of a single thin region 146 are each between about 1% and about 10%, between about 1% and about 6%, between about 2% and about 5%, between about 3% and about 4%, or about 3% of the length 90 of the male closure element 86. In other words, a single thin region 146 and a single oversized region 162 define a combined length that is between about 1% and about 20%, between about 1% and about 10%, between about 2% and about 8%, between about 3% and about 6%, between about 4% and about 6%, or about 5% of the length 90 of the male closure element 86.

The total length of the oversized regions 162 combined with the total length of the thin regions 146 is equal to the length 90 of the male closure element 86. Preferably, a total number of oversized regions 162 is between about 50% and about 150%, between about 75% and about 125%, between about 90% and about 110%, between about 90% and about 100%, between about 100% and about 110%, or about 100% of a total number of thin regions 146. In some aspects, the thin regions 146 define uniform spacing between the oversized regions 162 such that the male closure element 86 is characterized by alternating thin and oversized regions 146, 162. Alternatively, the oversized regions 162 may be spaced from one another by the thin regions 146 at irregular intervals.

Referring now to FIG. 5B, a detail view of the female closure profile 78 of the closure system 44 of FIGS. 1-4 is shown. The female closure profile 78 comprises a base portion 170, an upper arm 172, and a lower arm 174. The upper arm 172 and the lower arm 174 are spaced apart from one another and extend outward with respect to the base portion 170. The upper arm 172 has an upper hook portion 176 at the distal free end thereof, and the lower arm 174 has a lower hook portion 178 at the distal free end thereof. The female closure profile 78 further defines a cavity 180, which is configured to receive the male closure element 86, and a trapezoidal cross section between the upper arm 172, the lower arm 174, and a back cavity surface 182. The back cavity surface 182 is connected to the upper arm 172 and the lower arm 174 and is defined by a vertical line or plane 184 The upper arm 172 and the lower arm 174, and more specifically distal ends 186 of the upper hook portion 176 and the lower hook portion 178, define an opening 188 into the cavity 180, into which the head of the male closure element 86 is inserted to seal the pouch 40. The female closure element 88 is symmetrical about the centerline 122 such that the centerline 122 extends through the cavity 180 and the opening 188; however, alternative asymmetric embodiments are contemplated. The upper arm 172 and the lower arm 174 are configured to deflect inward or outward when the male closure element 86 is inserted into or removed from the cavity 180. In some aspects, the upper hook portion 176 and the lower hook portion 178 are configured to deflect inward or outward independently of the upper arm 172 and the lower arm 174 when the male closure element 86 is inserted into or removed from the cavity 180.

The female closure element 88 further defines a height 190 and a thickness 192, the cavity 180 defines a height 194 and a thickness 196, and the opening 188 defines a height 198 and a thickness 200. In some embodiments, the thickness 196 is between about 40% and about 80%, between about 50% and about 70%, between about 55% and about 60%, at least about 50%, at least about 55%, or at least about 60% of the thickness 192 of the female closure element 88. The thickness 200 of the opening 188 is between about 10% and about 50%, between about 20% and about 40%, between about 30% and about 25%, or at least about 30% of the thickness 196 of the cavity 180. The height 194 of the cavity 180 is between about 50% and about 70%, between about 55% and about 65%, or at least about 60% of the height 190 of the female closure element 88. The height 198 of the opening 188 is between about 10% and about 50%, between about 20% and about 40%, between about 30% and about 25%, or at least about 30% of the height 194 of the cavity 180.

The cavity 180 is at least partially defined by inner surfaces 202*a*, 202*b*, which define inner surfaces 202*a*, 202*b* of upper hook portion 176 and lower hook portion 178, respectively. The inner surfaces 202*a*, 202*b* may be defined as sealing surfaces, as these surfaces align with portions of the male closure element 86 to provide an enhanced seal. The cavity 180 is also at least partially defined by lateral surfaces 204*a*, 204*b* that extend along the upper arm 172 and the lower arm 174. The inner surfaces 202*a*, 202*b* are angled inward from the distal ends 186 of the upper arm 172 and the lower arm 174 toward the plane 184. Finally, the back cavity surface 182 defines an innermost surface 206 of the cavity 180. In the present embodiment, the back cavity surface 182 extends along the plane 184 and does not follow a profile of the male closure element 86. While not shown in FIG. 5B, it is contemplated that one or more of the inner surfaces 202*a*, 202*b* or the lateral surfaces 204*a*, 204*b* may follow the profile of the male closure element 86 in other embodiments. In the present embodiments, surfaces that do not follow a corresponding profile portion can be considered to have different shapes or curvatures defining the respective surfaces, i.e., they do not mirror one another or have profiles that substantially conform with one another.

It is contemplated that alternative configurations may exist for the female closure profile 78. In some embodiments, more or fewer surfaces may be included. For example, the cavity 180 may be defined by the inner surfaces 202*a*, 202*b*, and a generally circular outer surface (not shown) that extends from outermost points of the inner surfaces 202*a*, 202*b*. To that end, the cavity 180 may define a variety of cross-sectional areas, and may be in the shape of a square, a rectangle, a triangle, a hexagon, etc. In some embodiments, multiple sub-cavities may be defined by the various surfaces that define the cavity 180 such that multiple compartments are formed that receive the male closure element 86. In some embodiments, the cavity 180 may not be defined by the lateral surfaces 204*a*, 204*b*, and may instead only include an outer surface (not shown) which may extend from intersections with the inner surfaces 202*a*, 202*b*, i.e., to define a circular or semi-circular cross section.

FIG. 5C is a detail view of the male and female closure profiles 76, 78 of FIGS. 5A and 5B in a closed configuration. The closed configuration is realized when the male closure profile 76 is inserted into the cavity 180 of the female closure profile 78. When initially inserted into the cavity 180, the secondary profile 120 of the male closure element 86 causes the upper arm 172 and the lower arm 174 of the female closure element 88 to spread open to a greater degree than the primary profile 118, and the upper arm 172 and lower arm 174 snap back to their original configuration after the male closure element 86 has been inserted entirely into the cavity 180. In other words, the upper arm 172 and the lower arm 174 create an audible snap or click when they return to their original configuration and form a water-tight seal with the male closure element 86 after the secondary profile 120 of the male closure element 86 has been passed through the opening 188 and into the cavity 180. The audible clicking may have a specific sound level that is measured in decibels (dB), and the frequency of the audible clicking is an important factor in determining user preference. For example, the audible clicking may have a sound level that is between about 0 dB and about 80 dB. Moreover, inserting head portion 116 into the cavity 180 provides enhanced tactile feedback characterized by each of the oversized regions 162 being fully inserted into the cavity 180 since the secondary profile 120 is non-continuous along the length 90 of the male closure element 86. This is particularly advantageous for silicone closure mechanisms which are typically larger, thicker, and more resilient than zippers for thermoplastic bags.

Still referring to FIG. 5C, the closure system 44 defines a total thickness 208. In some aspects, the height 132 of the secondary profile 120 is between about 50% and about 100%, between about 60% and about 90%, between about 70% and about 80%, between about 80% and about 90%, at least about 80%, at least about 85%, at least about 90%, or at least about 95% of the height 194 of the cavity 180. In some aspects, the thickness 134 of the secondary profile 120 is between about 75% and about 125%, between about 85% and about 115%, between about 90% and about 110%, between about 95% and about 105%, at least about 80%, at least about 90%, at least about 95%, or at least about 100% of the thickness 200 of the opening 188. Still referring to FIG. 5C, the height 136 of the stem 114 is between about 50% and about 200%, between about 75% and about 150%, between about 90% and about 130%, between about 100% and about 120%, at least about 90%, at least about 100%, at least about 110%, at least about 120%, or at least about 130% of the height 198 of the opening 188.

In some embodiments, the height 136 of the stem 114 is between about 10% and about 50% of the height 190 of the female closure element 88, or between about 20% and about 40% of the height 190 of the female closure element 88, or between about 25% and about 35% of the height 190 of the female closure element 88, or less than about 50%, or less than about 40%, or less than about 30%, or less than about 20% of the height 190 of the female closure element 88.

Through testing, it was determined that having the stem 114 with the height 136 that is at least the same as the height 198 of the opening 188 provides for enhanced sealing of the closure system 44. To that end, the opening 188 is preferably smaller than the stem 114. It is preferable to require between about 3 pounds force (lbf) (13 newtons (N)) and about 10 lbf (45 N) to open and close the closure system 44. In some embodiments, between about 3 lbf (13 N) and about 20 lbf (90 N), between about 5 lbf (22 N) and about 15 lbf (67 N), or between about 7 lbf (31 N) and about 12 lbf (53 N) is required to open and close the closure system 44. This feature is achieved by the design of the upper and lower arms 172, 174 of the female closure element 88 and the corners of the male head portion 116. The outer corner 142 of the head portion 116 controls the force required for the contents to fall out of the pouch or container when in the closed configuration, while the inner corners 144 of the primary profile 118 or the side faces 152 of the secondary profile 120 control the force required to open and close the closure system 44.

Referring again to FIG. 5D, the mold 164 includes a male mold cavity 210 and a female mold cavity 212. The female mold cavity 212 includes an upper arm groove 214 and a lower arm groove 216. The male mold cavity 210 includes oversized grooves 218 spaced from one another by portions of a thin groove 220. As previously discussed, an LIM process or another manufacturing process is utilized to mold the male closure profile 76 and the female closure profile 78 with the pouch as a unitary construction. While not explicitly shown in FIG. 5D, it is contemplated that either end of the male mold cavity 210 or the female mold cavity 212 can be formed in any shape that is particularly desirable, such as molding either end of the male or female mold cavities 210, 212 to include a curved edge 222 (see, e.g., FIGS. 7D, 8D, 9D, and 10D) to provide further auditory/tactile feedback when engaging the closure system 44 at either end of the pouch 40. Additionally, it is contemplated that the oversized grooves 218 are disposed asymmetrically within the male closure profile 76 with respect to the thin groove 220 (see FIG. 10D). In some embodiments, the oversized grooves 218 are intermittently spaced from one another across the thin groove 220 to define an asymmetric oversized region pattern.

Figure 6B:
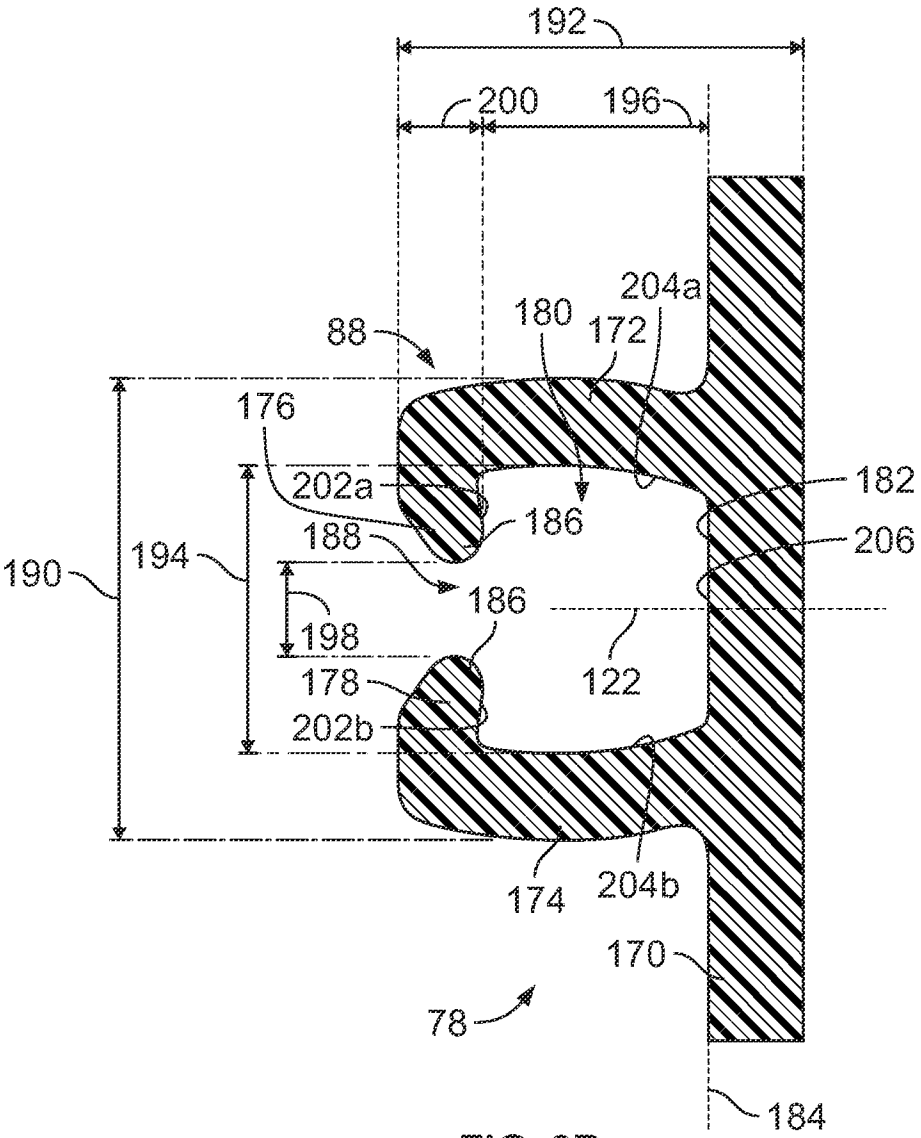
FIG. 6B is a detail view of another female closure profile of the closure system of FIGS. 1-4, according to some aspects of the present disclosure.
Figure 6A:
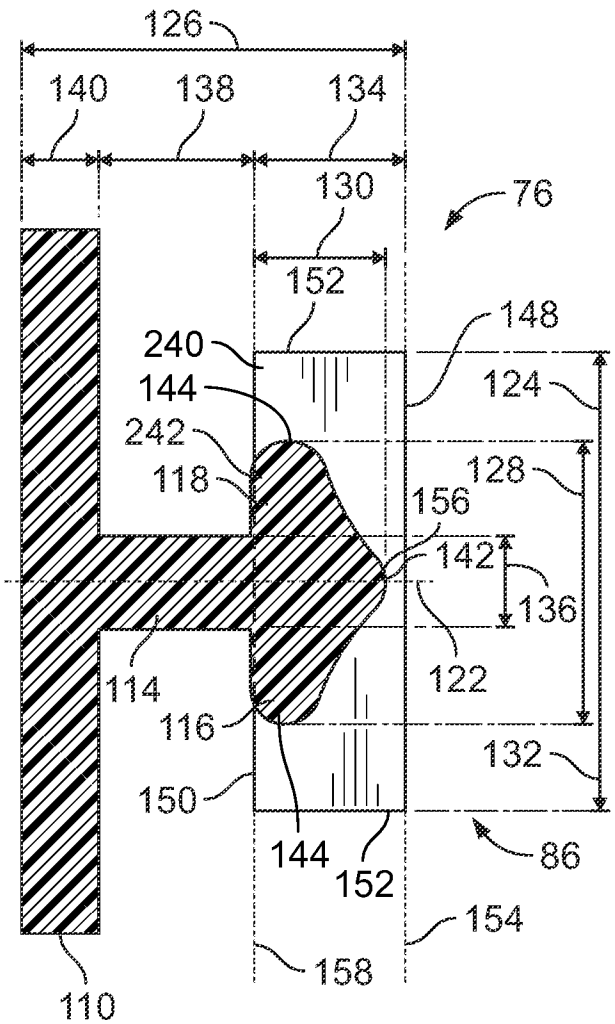
FIG. 6A is a detail view of another male closure profile of the closure system of FIGS. 1-4, according to some aspects of the present disclosure.

Referring now to FIGS. 6A-6D, another example of the closure system 44 is shown in which the female closure element 88 is similar to the female closure element 88 of FIG. 6A, but differing in that the male closure element 86 includes a secondary profile 240 that is larger than the secondary profile 120 illustrated in FIGS. 5A-5D. Referring specifically now to FIG. 6A, the outward face 148 of the secondary profile 240 is defined by the first vertical line or plane 154 that extends perpendicularly through the centerline 122 and past the outermost point of the primary profile 118. In some embodiments, an outermost point of the secondary profile 240, defined by the first vertical plane 154, extends past the outermost point of the primary profile 118 such that the outer corner 142 of the primary profile 118 is spaced from the outward face 148 of the secondary profile 240. The outward face 148 extends between the side faces 152 along the first vertical plane 154, and a height 132 of the secondary profile 240 is measured in a direction perpendicular with respect to the centerline 122 and between the side faces 152. A thickness 134 of the secondary profile 240 is measured in a direction parallel with respect to the centerline 122 and inwardly from the outward face 148 to the inward face 150, the inward face 150 defined by the second vertical plane 158 that extends in a direction that is parallel to the first vertical plane 154 at an innermost point 242 or plane of the primary profile 118.

The side faces 152 extend between the outward face 148 and the inward face 150. In some embodiments, side faces 152 are spaced from the inner corners 144 such that the primary profile 118 is completely enveloped by the secondary profile 240. In some aspects, the height of the secondary profile 240 is between about 100% and about 200%, between about 100% and 150%, between about 110% and about 135%, between about 115% and about 125%, or between about 120% and about 130% of the height 128 of the primary profile 118. Further, the thickness 134 of the secondary profile 120 is between about 80% and about 120%, between about 90% and about 115%, between about 95% and about 105%, at least about 100%, or about 100% of the thickness 130 of the primary profile 118. In this way, the oversized regions 162 are entirely defined by the secondary profile 240 since the secondary profile 240 completely envelops the primary profile 118. In some embodiments, the height 132 of the secondary profile 240 is between about 175% and about 225%, or about 200% of the height 132 of the secondary profile 120 illustrated in FIG. 5A. In some embodiments, the thickness 134 of the secondary profile 240 is between about 200% and about 220%, or about 210% of the thickness 134 of the secondary profile 120 illustrated in FIG. 5A.

Figure 6C:
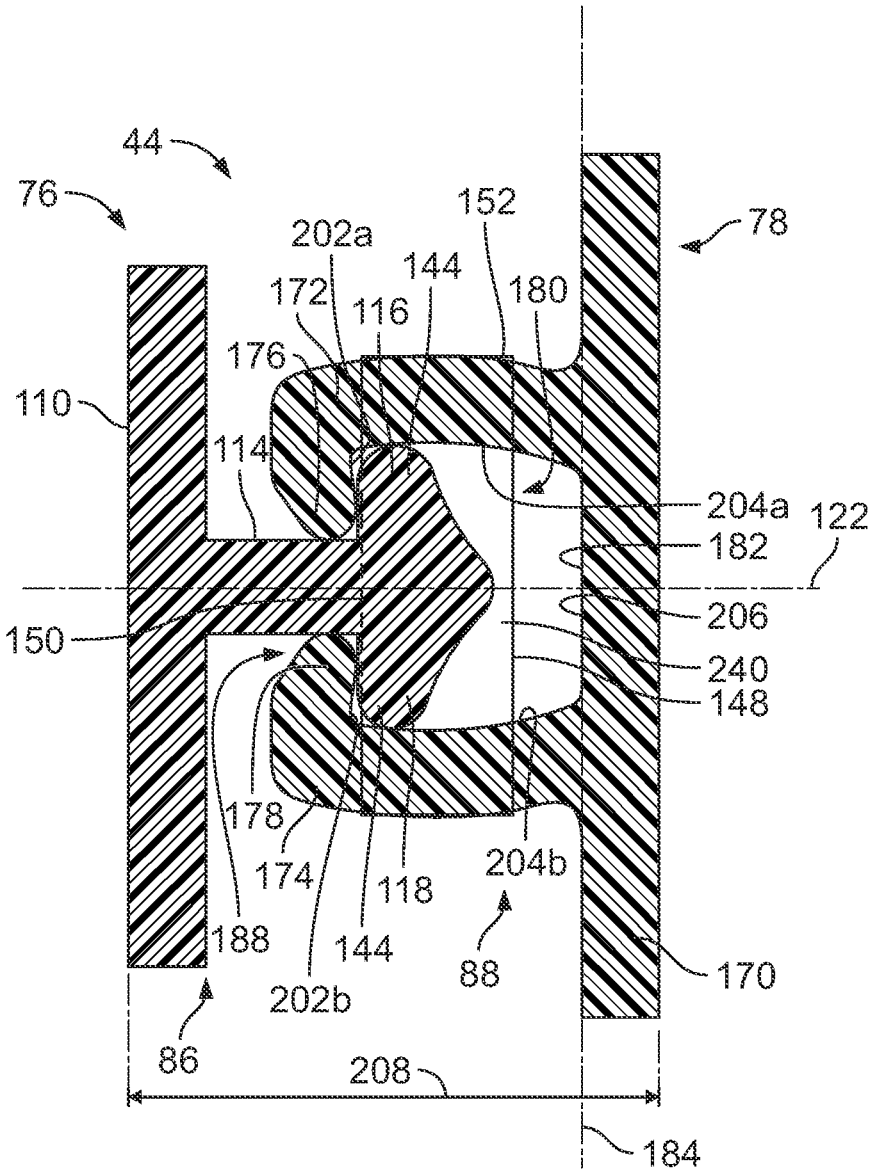
FIG. 6C is a detail view of the male and female closure profiles of FIGS. 6A and 6B in a closed configuration.
Figure 6D:
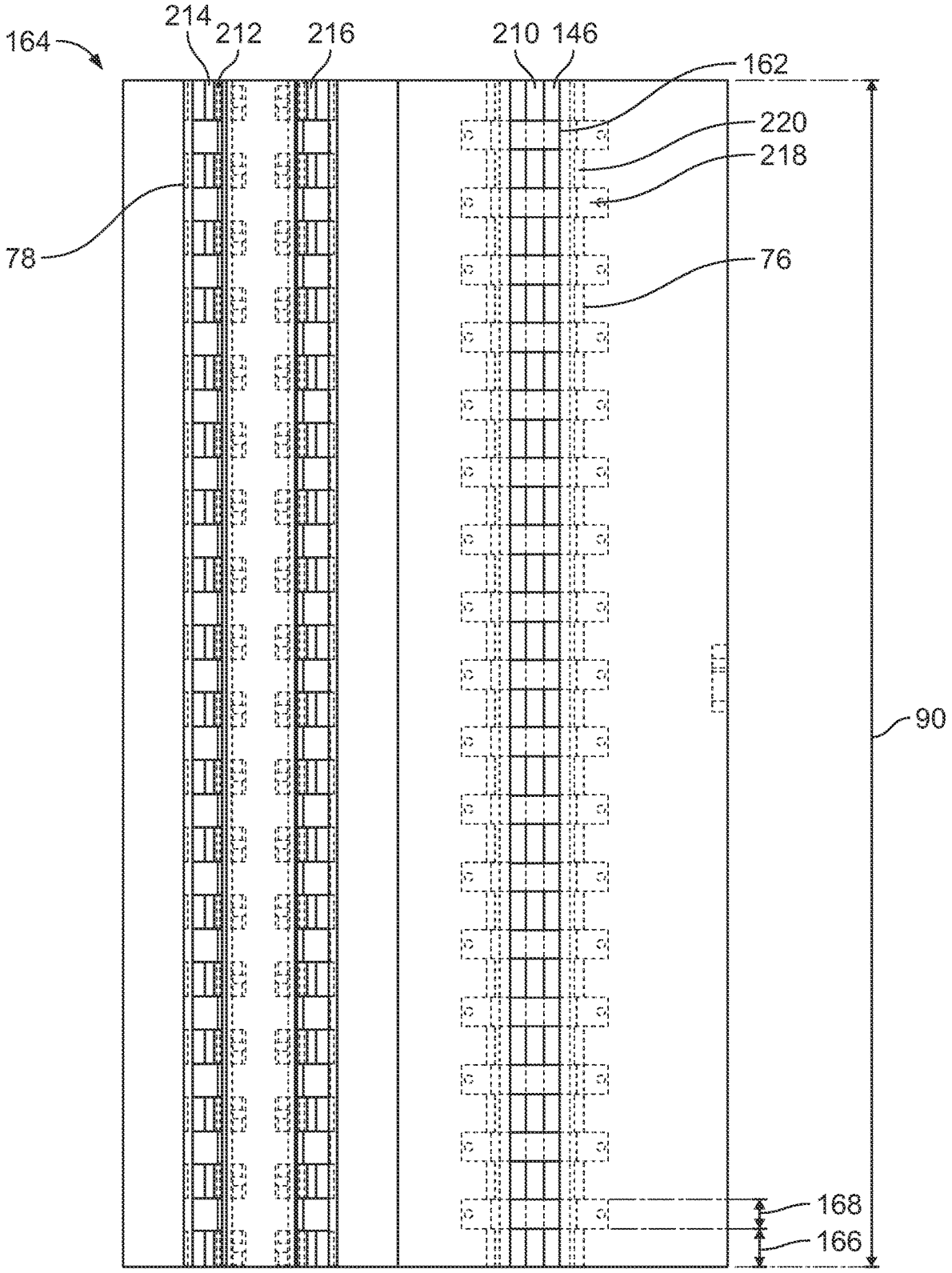
FIG. 6D is a top view of a mold used to manufacture the male and female closure profiles of FIGS. 6A-6C.

Referring now to FIG. 6C, the height 132 of the secondary profile 240 is between about 100% and about 200%, between about 125% and about 175%, between about 140% and about 160%, between about 145% and about 155%, at least about 125%, at least about 140%, or at least about 150% of the height 194 of the cavity 180. In some aspects, the thickness 134 of the secondary profile 240 is between about 50% and about 100%, between about 60% and about 90%, between about 70% and about 80%, between about 80% and about 90%, or at least about 75% of the thickness 200 of the opening 188. Still referring to FIG. 6C, the height 136 of the stem 114 is between about 50% and about 200%, between about 75% and about 150%, between about 90% and about 130%, between about 100% and about 120%, at least about 90%, at least about 100%, at least about 110%, at least about 120%, or at least about 130% of the height 198 of the opening 188.

Figure 7B:
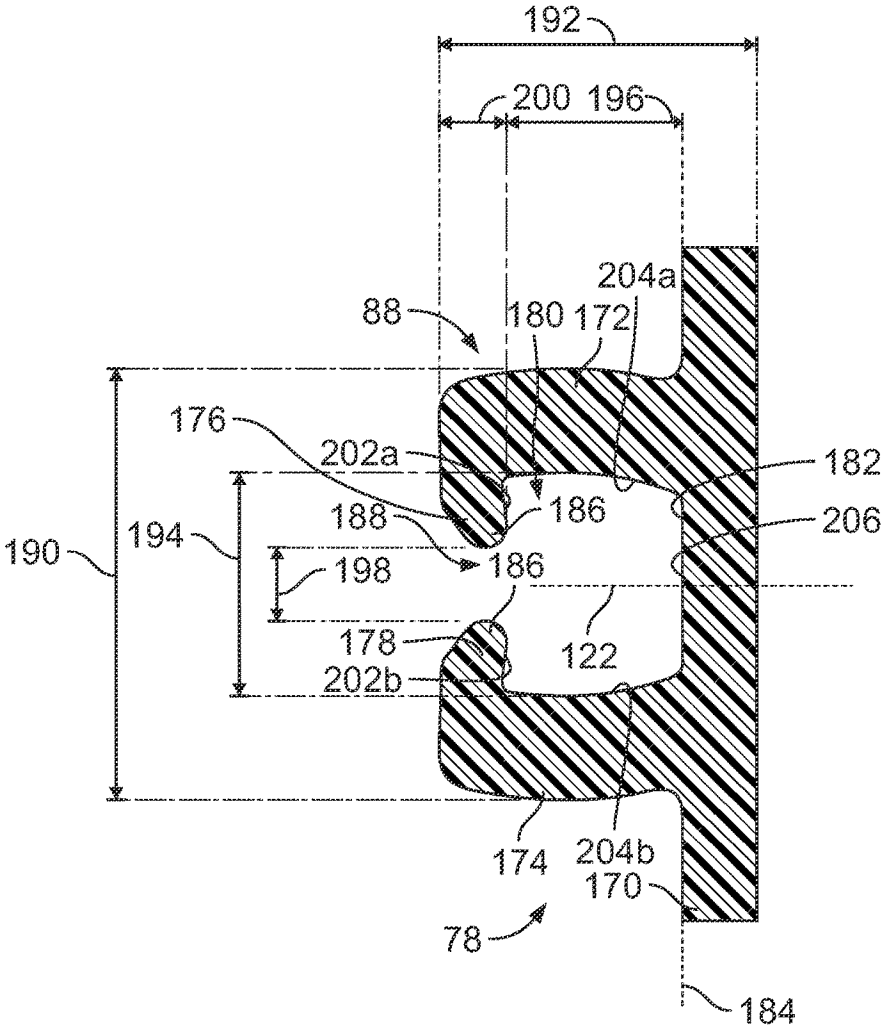
FIG. 7B is a detail view of yet another female closure profile of the closure system of FIGS. 1-4, according to some aspects of the present disclosure.
Figure 7A:
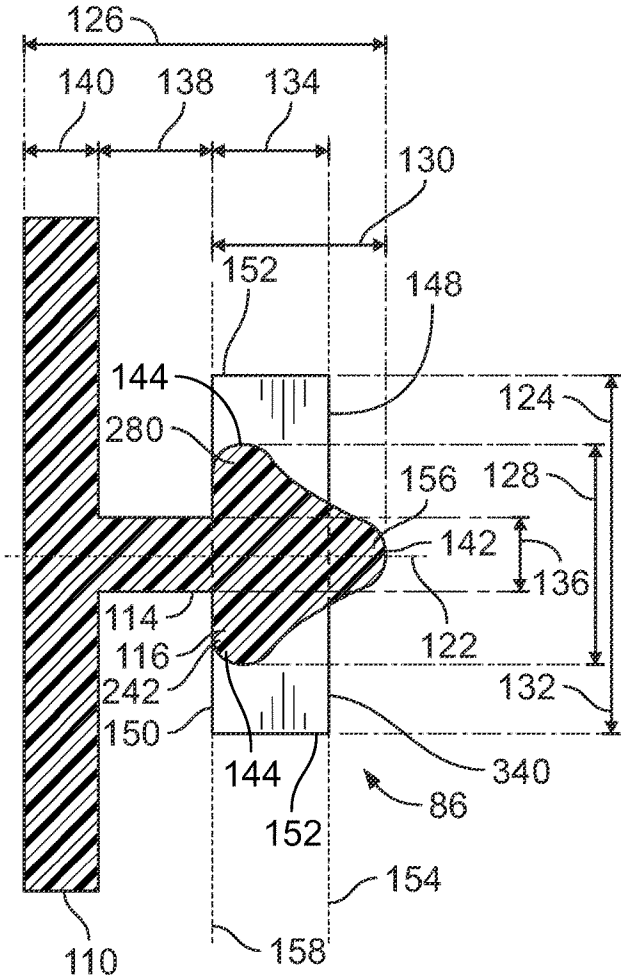
FIG. 7A is a detail view of yet another male closure profile of the closure system of FIGS. 1-4, according to some aspects of the present disclosure.

Referring now to FIGS. 7A-7D, yet another example of the closure system 44 is shown, in which the cavity 180 of the female closure element 88 is similar to the cavity 180 illustrated in FIG. 6A. Additionally, the male closure element 86 includes a primary profile 280 that is thicker than the primary profile 118 and a secondary profile 340 that is thinner than the secondary profile 240 as illustrated in FIGS. 5A-6D. Referring specifically to FIG. 7A, the outward face 148 is defined by the first vertical line or plane 154 that extends perpendicularly through the centerline 122 and through a point of the primary profile 280 such that the outer corner 142 of the primary profile 280 extends past the outward face 148. The outward face 148 extends between the side faces 152 along the vertical plane, and a height 132 of the secondary profile 340 is measured in a direction perpendicular with respect to the centerline 122 and between the side faces 152. The thickness 134 of the secondary profile 340 is measured in a direction parallel with respect to the centerline 122 and inwardly from the outward face 148 to the inward face 150, defined by the second vertical plane 158 that extends in a direction that is parallel to the first vertical plane 154 at an innermost point 242 or plane of the primary profile 280.

The side faces 152 extend between the outward face 148 and the inward face 150. In some embodiments, side faces 152 are spaced outward from the inner corners 144. In some aspects, the height 132 of the secondary profile 340 is between about 100% and about 200%, between about 100% and about 200%, between about 140% and about 160%, between about 150% and about 170%, or between about 155% and about 165% of the height 128 of the primary profile 280. Further, the thickness 134 of the secondary profile 340 is between about 50% and about 100%, between about 60% and about 80%, between about 70% and about 80%, at least about 65%, or at least about 75% of the thickness 130 of the primary profile 280. In some embodiments, the thickness 130 of the primary profile 280 is between about 125% and about 175%, or about 150% of the thickness 130 of the primary profile 118 illustrated in FIG. 5A. In some embodiments, the height 132 of the secondary profile 340 is between about 75% and about 95%, or about 85% of the height 132 of the secondary profile 240 illustrated in FIG. 6A. In some embodiments, the thickness 134 of the secondary profile 340 is between about 70% and about 90%, or about 80% of the thickness 134 of the secondary profile 240 illustrated in FIG. 6A.

Figure 7C:
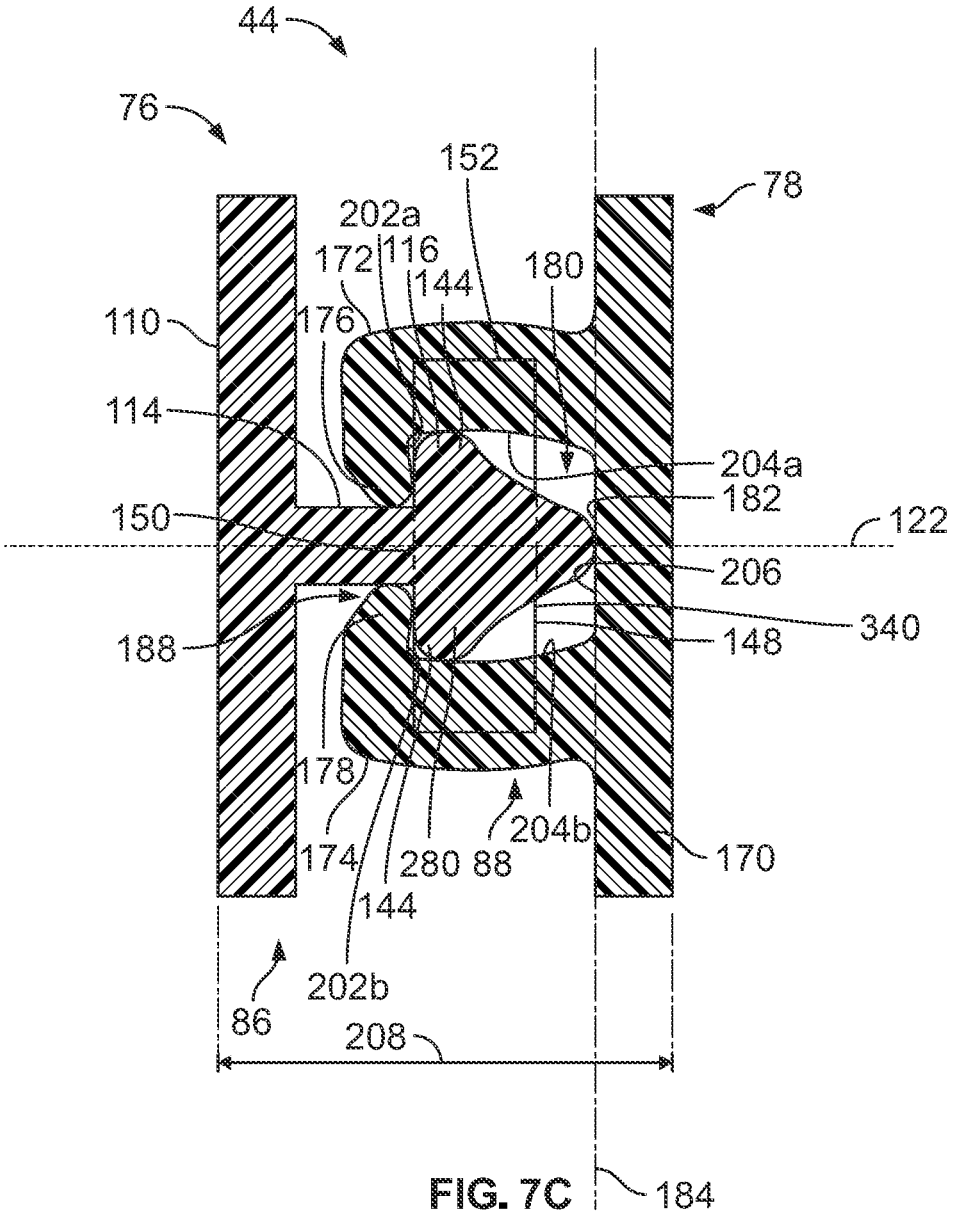
FIG. 7C is a detail view of the male and female closure profiles of FIGS. 7A and 7B in a closed configuration.
Figure 7D:
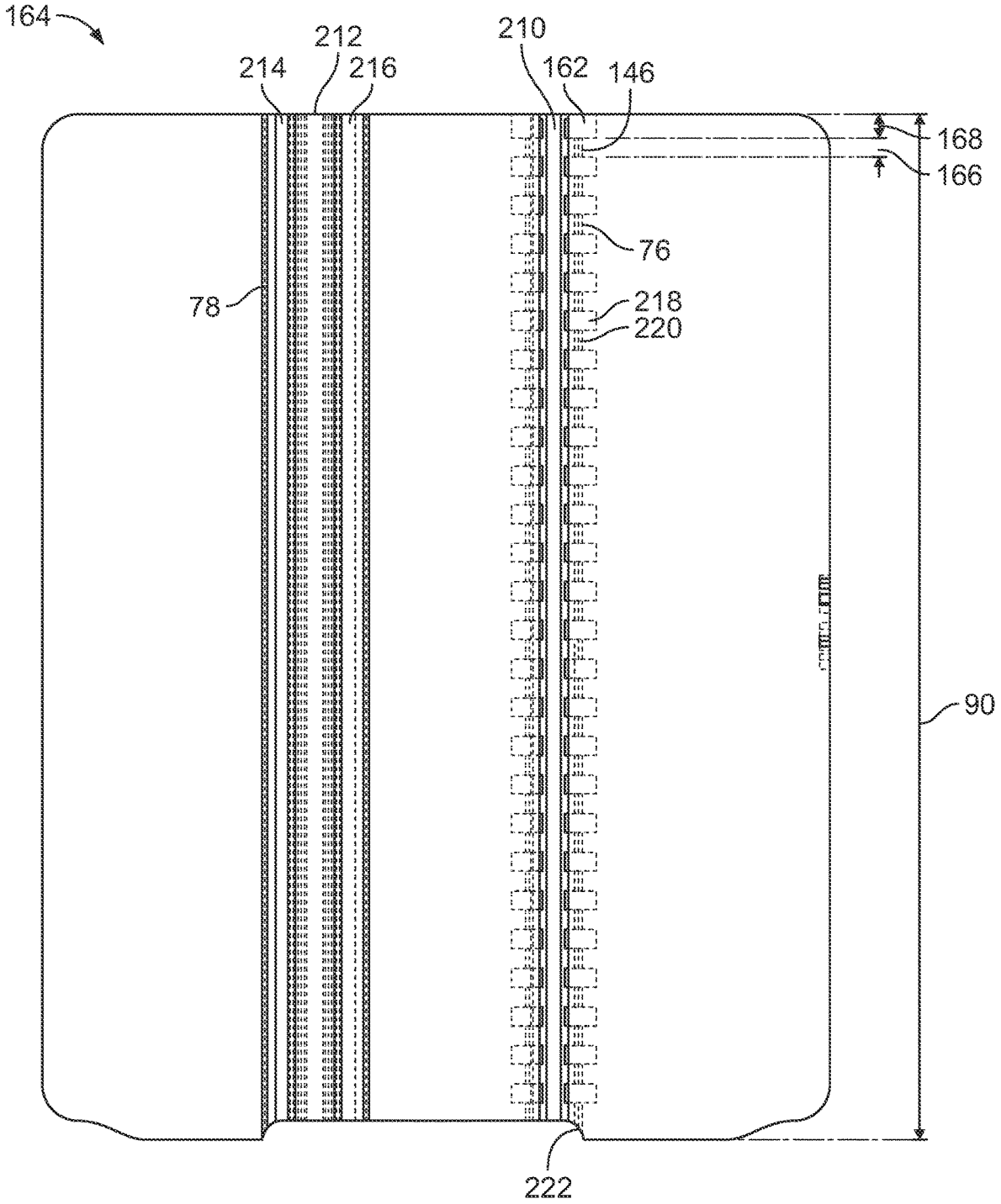
FIG. 7D is a top view of a mold used to manufacture the male and female closure profiles of FIGS. 7A-7C.

Referring now to FIG. 7C, the height 128 of the primary profile 280 is between about 90% and about 110% of the height 194 of the cavity 180, and the thickness 130 of the primary profile 280 is about 100% of the thickness 196 of the cavity 180. In some embodiments, the height 132 of the secondary profile 340 is between about 100% and about 200%, between about 100% and about 200%, between about 140% and about 160%, between about 150% and about 170%, or between about 155% and about 165% of the height 194 of the cavity 180. In some aspects, the thickness 134 of the secondary profile 340 is between about 50% and about 100%, between about 60% and about 80%, between about 70% and about 80%, at least about 65%, or at least about 75% of the thickness 196 of the cavity 180. Still referring to FIG. 7C, the height 136 of the stem 114 is between about 150% and about 250%, between about 175% and about 225%, between about 190% and about 120%, at least about 180%, or at least about 200% of the height 198 of the opening 188.

Referring now to FIGS. 8A-8D, still another example of the closure system 44 is shown, in which the male closure element 86 is similar to the male closure element 86 of FIG. 7C, but the female closure element 88 includes a cavity 180 that is taller than the profiles illustrated in FIGS. 5B, 6B, and 7B. Specifically referring to FIG. 8B, the thickness 196 of the cavity 180 is between about 40% and about 60%, between about 45% and about 55%, or at least about 50% of the thickness 192 of the female closure element 88. The thickness 200 of the opening 188 is between about 40% and about 60%, between about 45% and about 55%, or at least about 50% of the thickness 196 of the cavity 180. The height 194 of the cavity 180 is between about 50% and about 100%, between about 70% and about 80%, or at least about 75% of the height 190 of the female closure element 88. The height 198 of the opening 188 is between about 40% and about 60%, between about 45% and about 50%, or at least about 45% of the height 194 of the cavity 180. In some embodiments, the height 194 of the cavity 180 is between about 125% and about 175%, or about 150% of the height 194 of the cavity 180 illustrated in FIG. 7B. In some embodiments, the thickness 196 of the cavity 180 is between about 90% and about 110%, or about 100% of the thickness 196 of the cavity 180 illustrated in FIG. 7B.

Figure 8B:
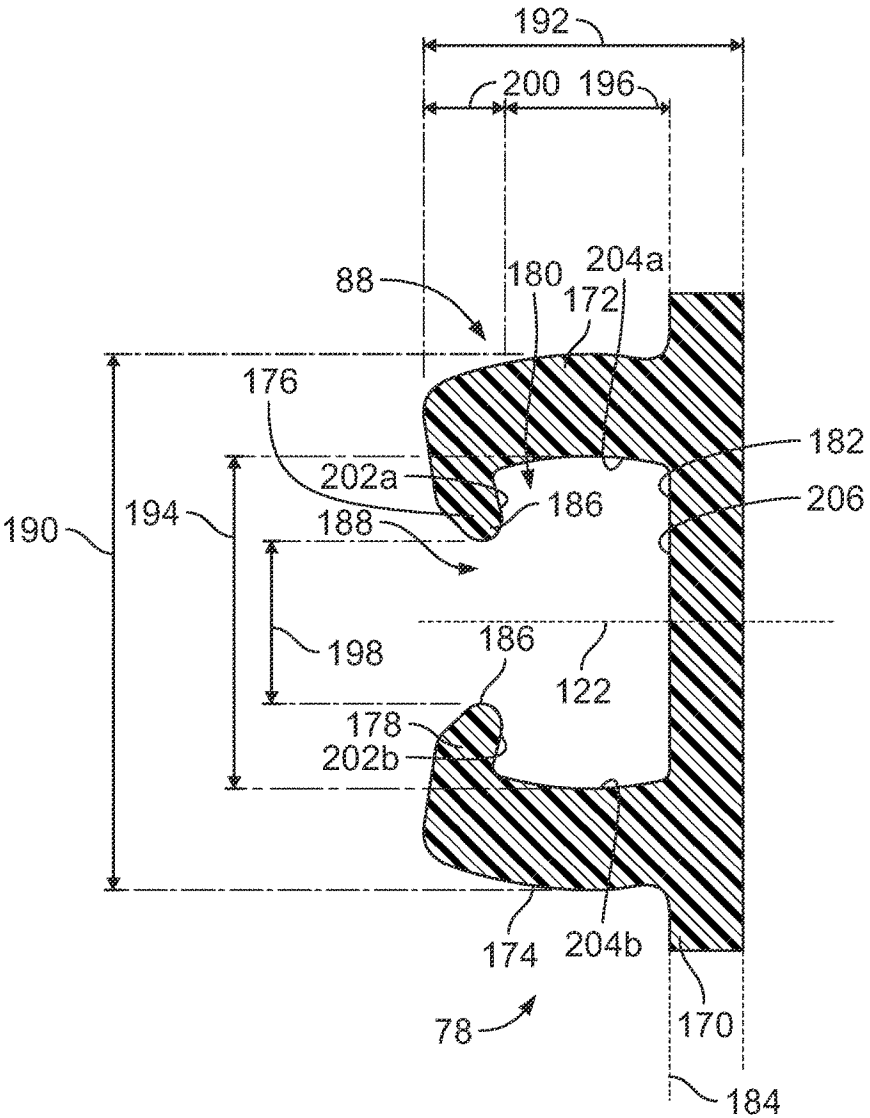
FIG. 8B is a detail view of still another female closure profile of the closure system of FIGS. 1-4, according to some aspects of the present disclosure.
Figure 8A:
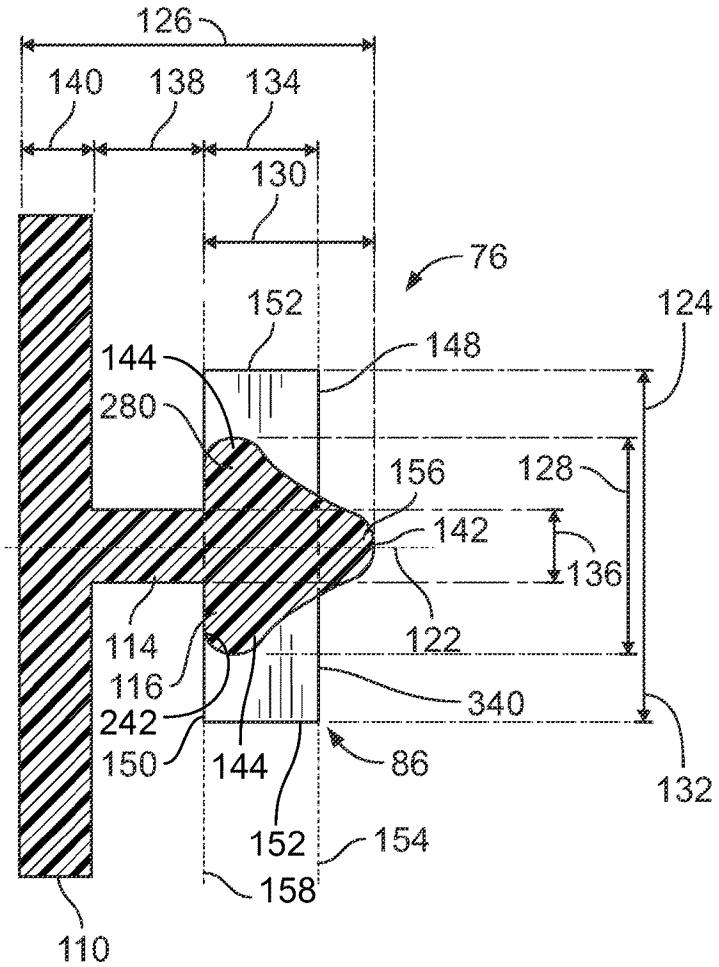
FIG. 8A is a detail view of still another male closure profile of the closure system of FIGS. 1-4, according to some aspects of the present disclosure.
Figure 8C:
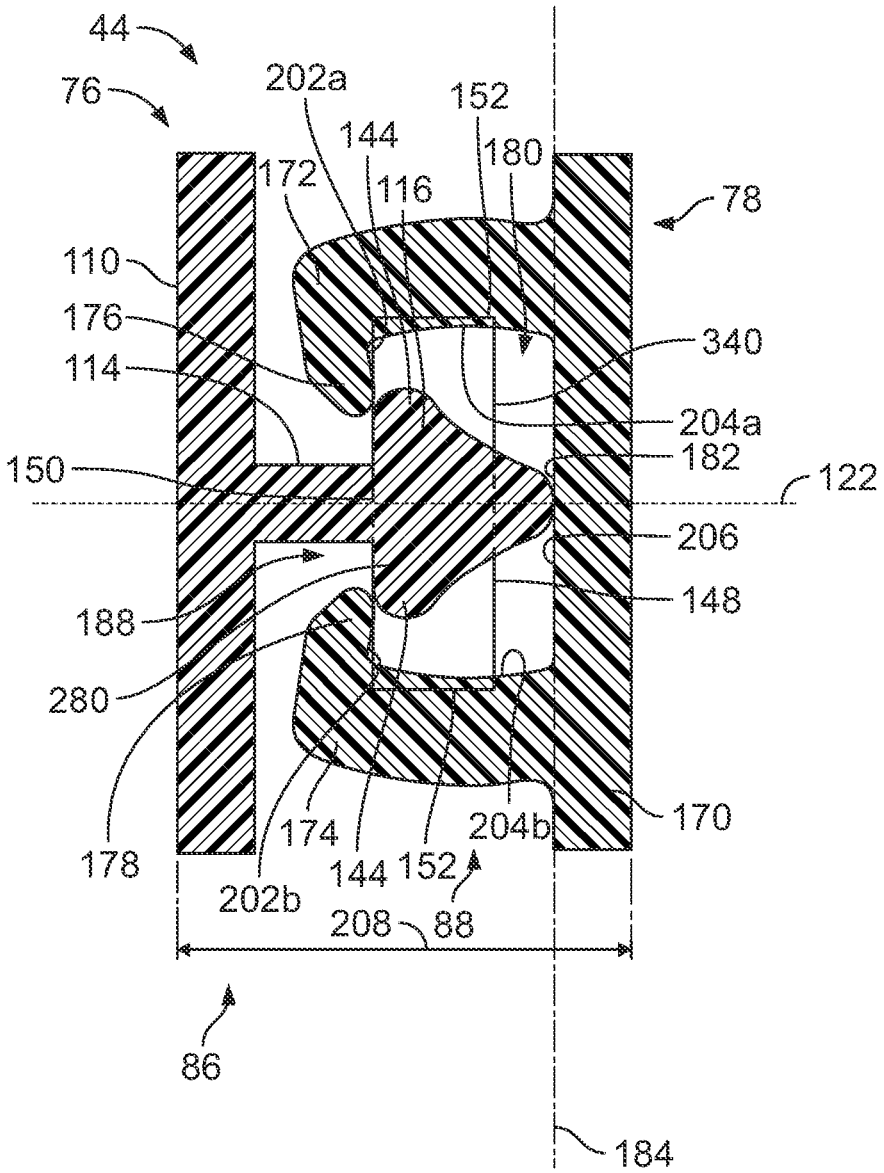
FIG. 8C is a detail view of the male and female closure profiles of FIGS. 8A and 8B in a closed configuration.
Figure 8D:
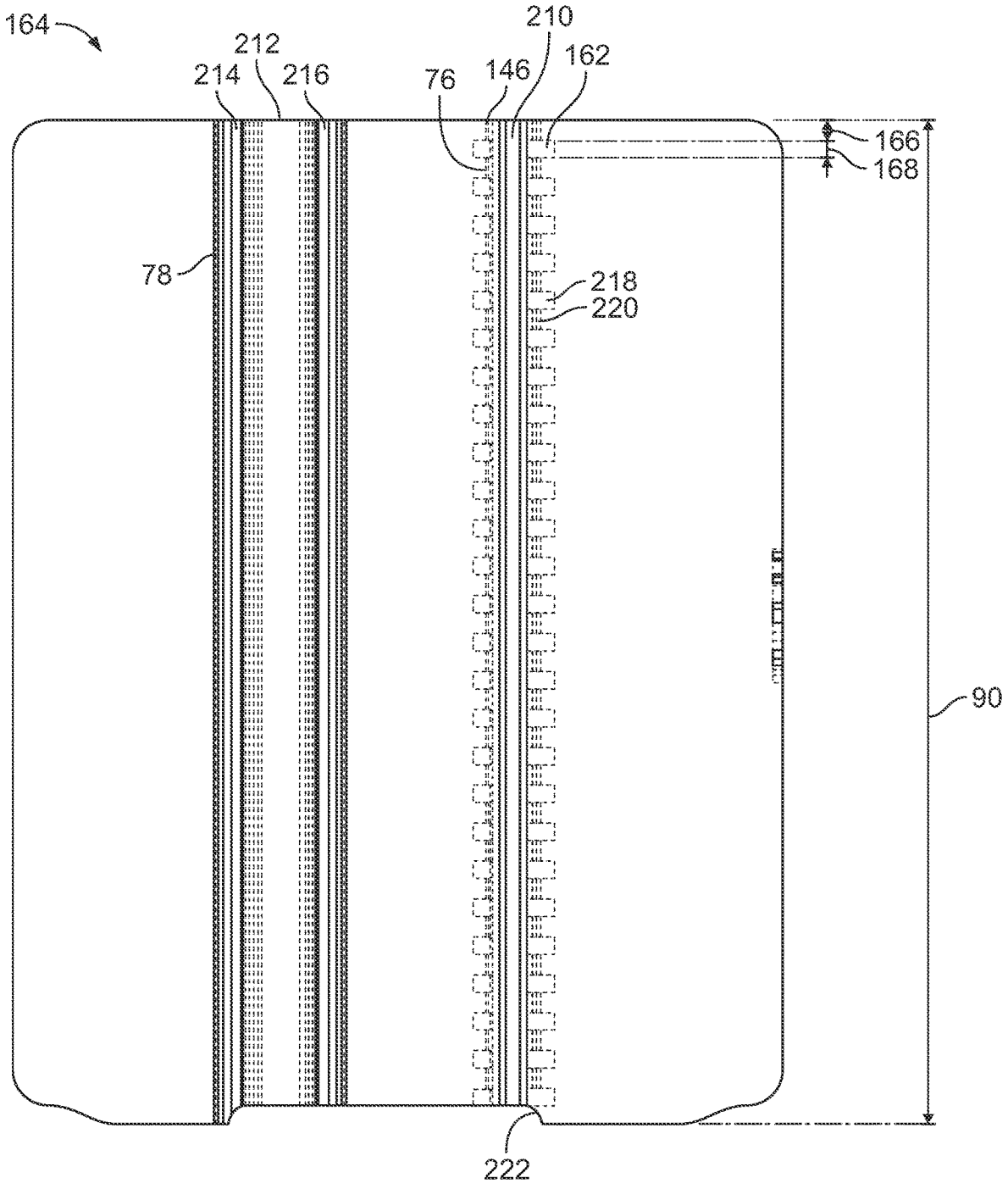
FIG. 8D is a top view of a mold used to manufacture the male and female closure profiles of FIGS. 8A-8C.

Referring now to FIG. 8C, the height 128 of the primary profile 280 is between about 50% and about 75% of the height 194 of the cavity 180, and the thickness 130 of the primary profile 280 is about 100% of the thickness 196 of the cavity 180. In some embodiments, the height 132 of the secondary profile 340 is between about 75% and about 125%, between about 90% and about 110%, between about 95% and about 105%, or at least about 100% of the height 194 of the cavity 180. In some aspects, the thickness 134 of the secondary profile 340 is between about 50% and about 100%, between about 60% and about 80%, between about 70% and about 80%, at least about 65%, or at least about 75% of the thickness 196 of the cavity 180. Still referring to FIG. 8C, the height 136 of the stem 114 is between about 50% and about 100%, between about 60% and about 80%, between about 70% and about 80%, at least about 75%, or about 75% of the height 198 of the opening 188.

Figure 9B:
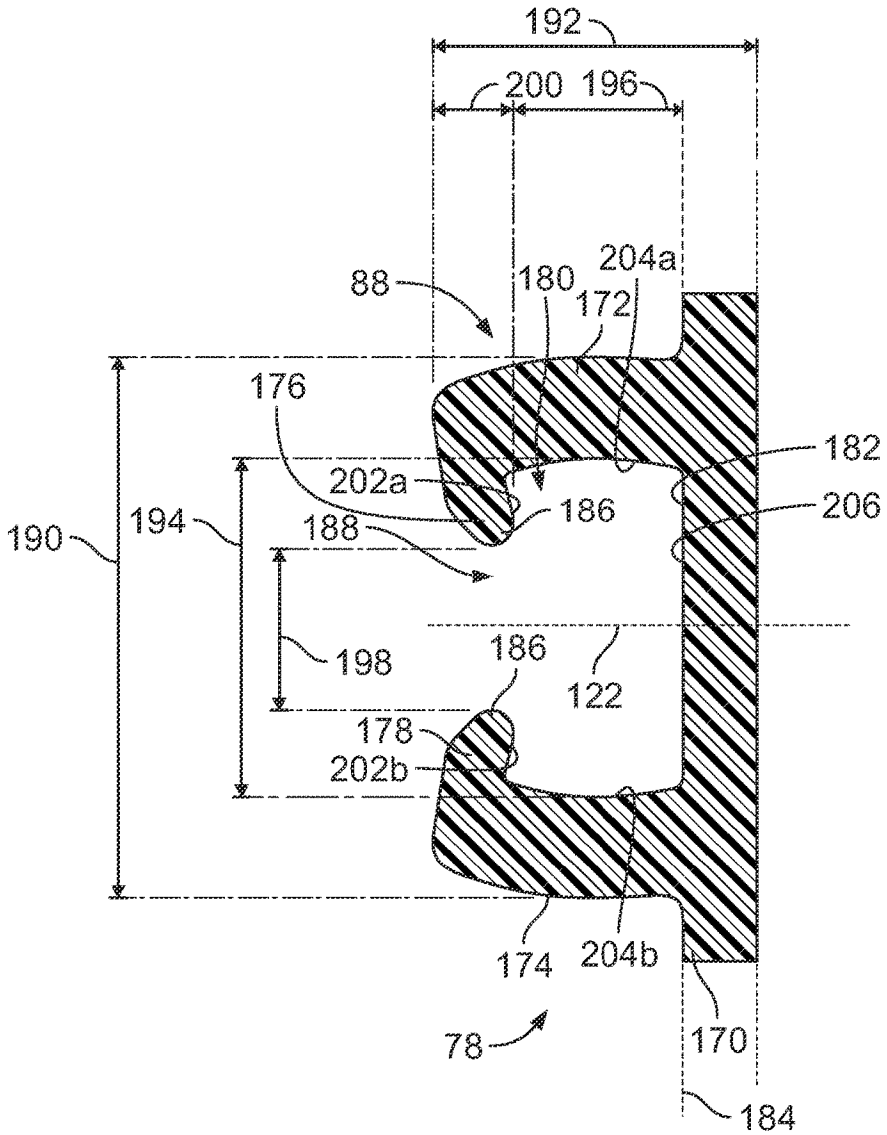
FIG. 9B is a detail view of another female closure profile of the closure system of FIGS. 1-4, according to some aspects of the present disclosure.
Figure 9A:
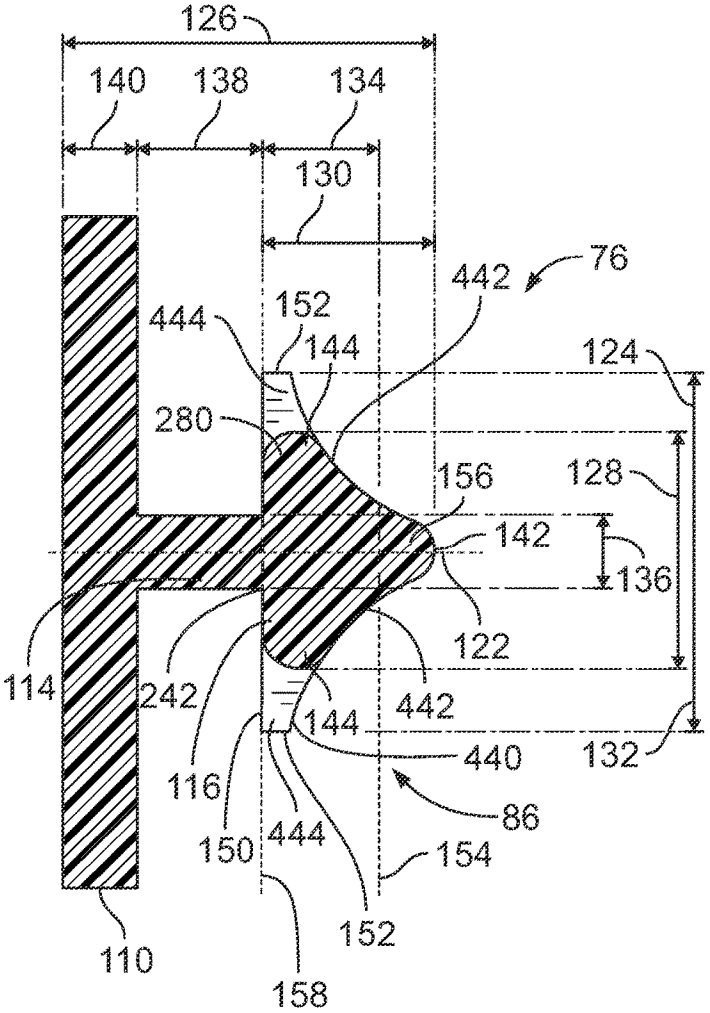
FIG. 9A is a detail view of another male closure profile of the closure system of FIGS. 1-4, according to some aspects of the present disclosure.

Referring now to FIGS. 9A-9D, another example of the closure system 44 is shown, in which the female closure element 88 is similar to the female closure element 88 of FIG. 8B, but the male closure element 86 includes a secondary profile 440 that is arrow-shaped rather than the rectangular profiles illustrated in FIGS. 5A, 6A, 7A, and 8A. Referring specifically to FIG. 9A, the secondary profile 440 defines an outward face 148, curved side faces 442, and an inward face 150 such that the curved side faces 442 connect the outward face 148 with the inward face 150. The outward face 148 is defined by the first vertical line or plane 154 that extends perpendicularly through the centerline 122 and through a point of the primary profile 280. The outer corner 142 of the primary profile 280 extends outward past the outward face 148 of the secondary profile 440. The outward face 148 extends between the curved side faces 442 along the vertical plane 154. In some embodiments, the curved side faces 442 extend along the primary profile 280, or the curved side faces do not extend directly along the primary profile 280 and instead extend beyond the primary profile 280. The curved side faces 442 further extend past the inner corners 144 and intersect with the inward face 150 to define oversized inner corners 444 of the secondary profile 440. In some aspects, the oversized inner corners 444 are truncated to define corner side faces 152 that join the inward face 150 with the curved side faces 442.

Referring in particular to FIG. 9A, the thickness 134 of the secondary profile 440 is measured in a direction parallel with respect to the centerline 122 and inwardly from the outward face 148 to the inward face 150, which is defined by the second vertical plane 158 that extends in a direction that is parallel to the first vertical plane 154 at an innermost point or plane of the primary profile 280. The curved side faces 442 extend between the outward face 148 and the inward face 150. The height 132 of the secondary profile 440 is measured in a direction perpendicular with respect to the centerline 122 and between the oversized inner corners 444 along the inward face 150. In some aspects, the height of the secondary profile 440 is between about 100% and about 200%, between about 125% and about 175%, between about 145% and about 155%, at least about 150%, or about 150% of the height 128 of the primary profile 280. Further, the thickness 134 of the secondary profile 440 is between about 50% and about 100%, between about 60% and about 80%, between about 60% and about 70%, or at least about 65% of the thickness 130 of the primary profile 280. In this way, the oversized regions 162 are entirely defined by the secondary profile 440 since the secondary profile 440 completely envelops the primary profile 280. In some embodiments, the height 132 of the secondary profile 440 is between about 90% and about 110%, or about 100% of the height 132 of the secondary profile 340 illustrated in FIG. 7A. In some embodiments, the thickness 134 of the secondary profile 440 is between about 90% and about 110%, or about 100% of the thickness 134 of the secondary profile 340 illustrated in FIG. 7A.

Figure 9C:
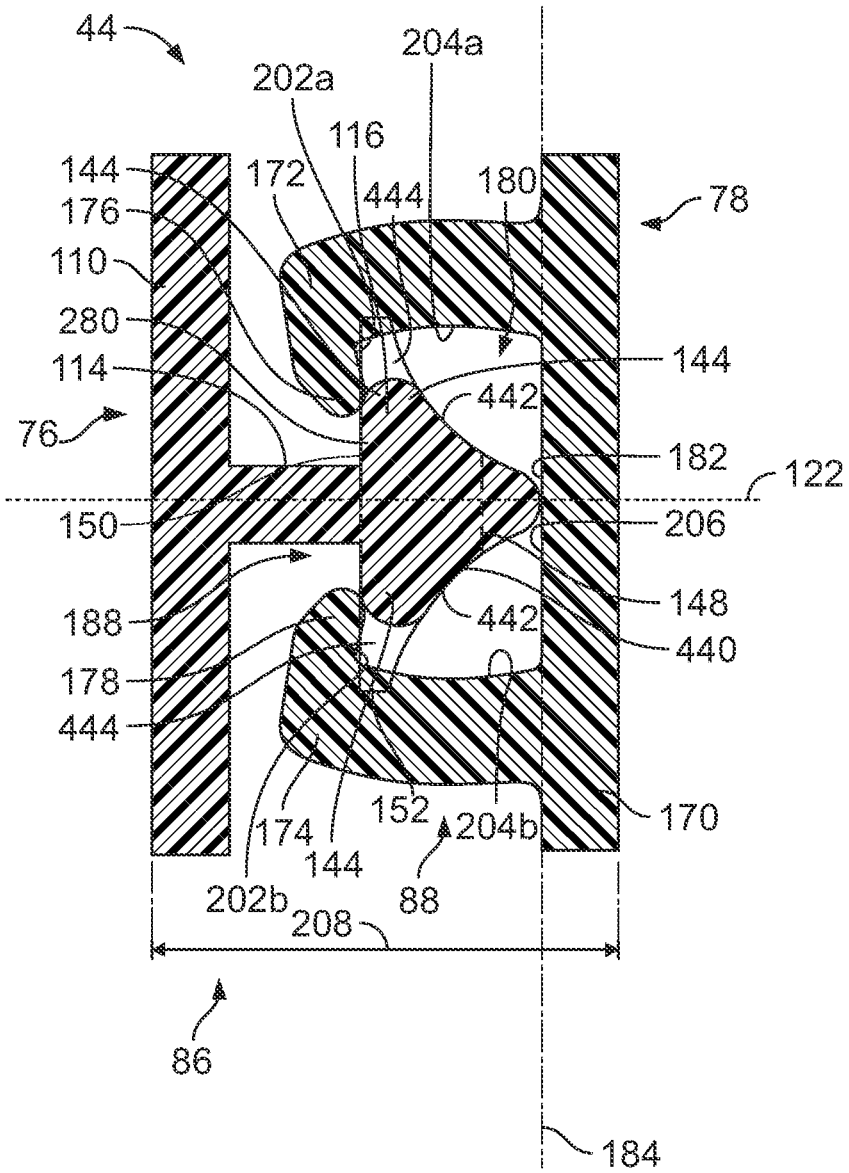
FIG. 9C is a detail view of the male and female closure profiles of FIGS. 9A and 9B in a closed configuration.
Figure 9D:
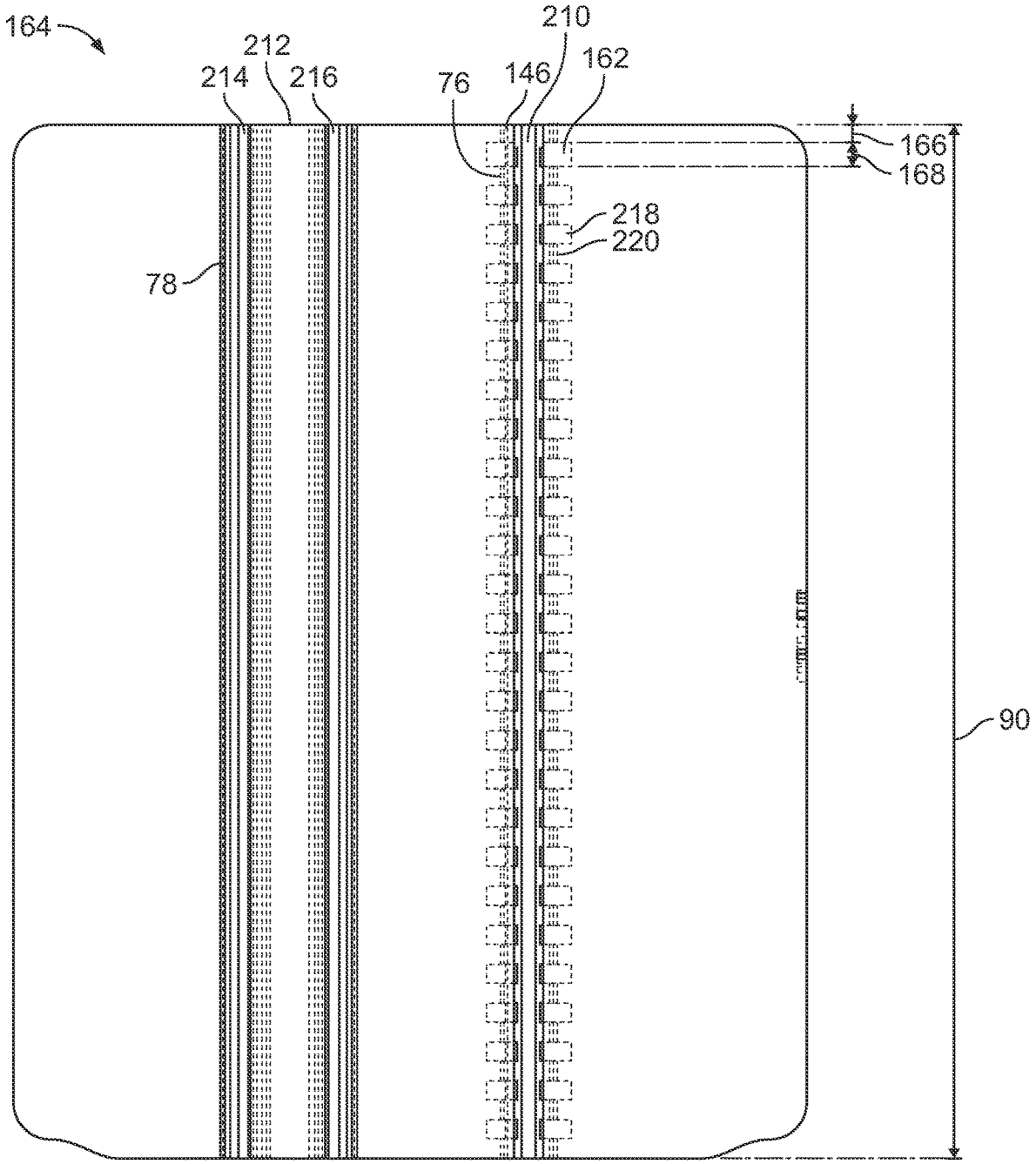
FIG. 9D is a top view of a mold used to manufacture the male and female closure profiles of FIGS. 9A-9C.

Referring now to FIG. 9C, the height 132 of the secondary profile 440 in some aspects, is between 75% and about 125%, between about 90% and about 110%, between about 95% and about 105%, or at least about 100% of the height 194 of the cavity 180. In some aspects, the thickness 134 of the secondary profile 440 is between about 50% and about 100%, between about 60% and about 80%, between about 60% and about 70%, or at least about 65% of the thickness 196 of the cavity 180. Still referring to FIG. 9C, the height 136 of the stem 114 is between about 50% and about 100%, between about 60% and about 80%, between about 70% and about 80%, at least about 75%, or about 75% of the height 198 of the opening 188.

Referring now to FIGS. 10A-10D, yet another example of the closure system 44 is shown, in which the male closure element 86 includes a stem 114 that is tapered rather than a stem 114 that is uniform in width, such as in FIGS. 5A, 6A, 7A, 8A, and 9A. Additionally, the female closure element 88 includes a cavity 180 that defines a smaller cross-section than the profile illustrated in FIG. 9B. Specifically referring to FIG. 10A, the stem 114 is tapered in a direction from the base region 110 to the head portion 116 such that the stem 114 becomes shorter as it extends toward the head portion 116. The height 136 of the stem 114 measured at along the second vertical plane 158 is between about 50% and about 100%, between about 60% and about 80%, between about 70% and about 80%, at least about 75%, or about 75% of the height 198 of the opening 188.

Figure 10B:
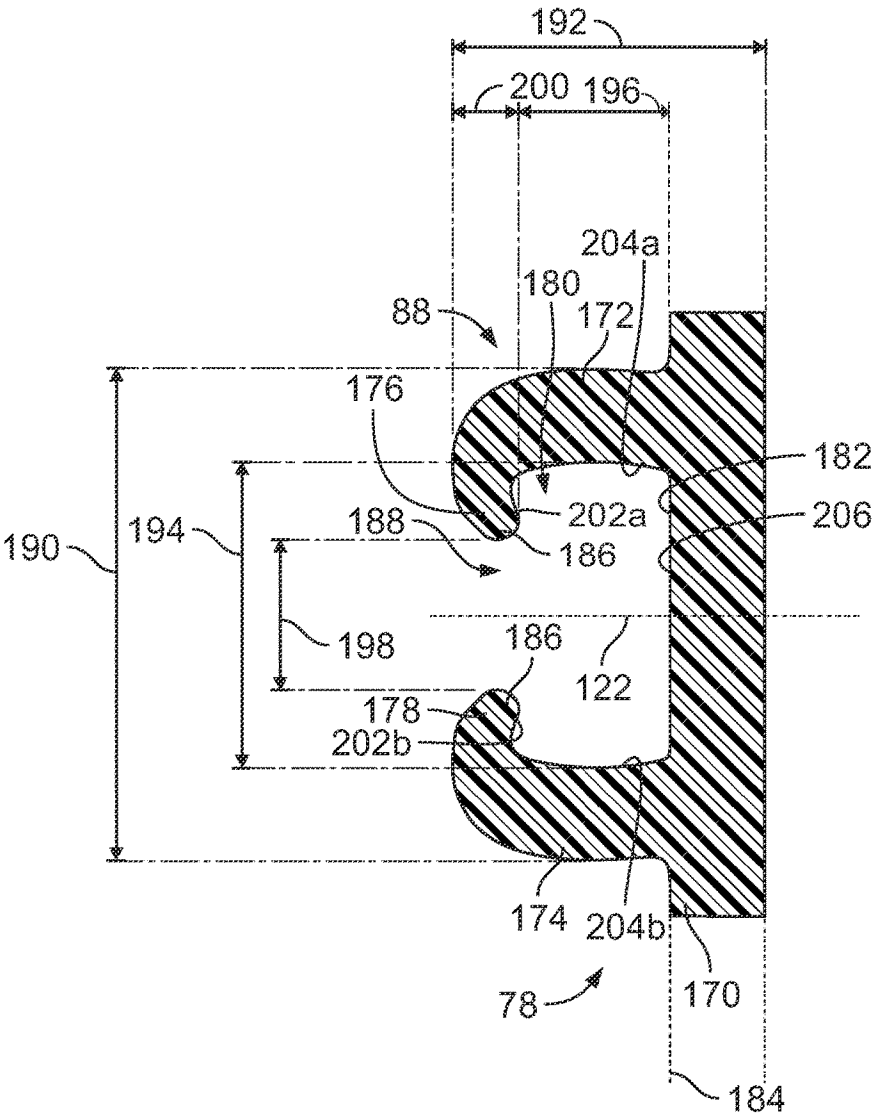
FIG. 10B is a detail view of yet another female closure profile of the closure system of FIGS. 1-4 according to some aspects of the present disclosure.
Figure 10A:
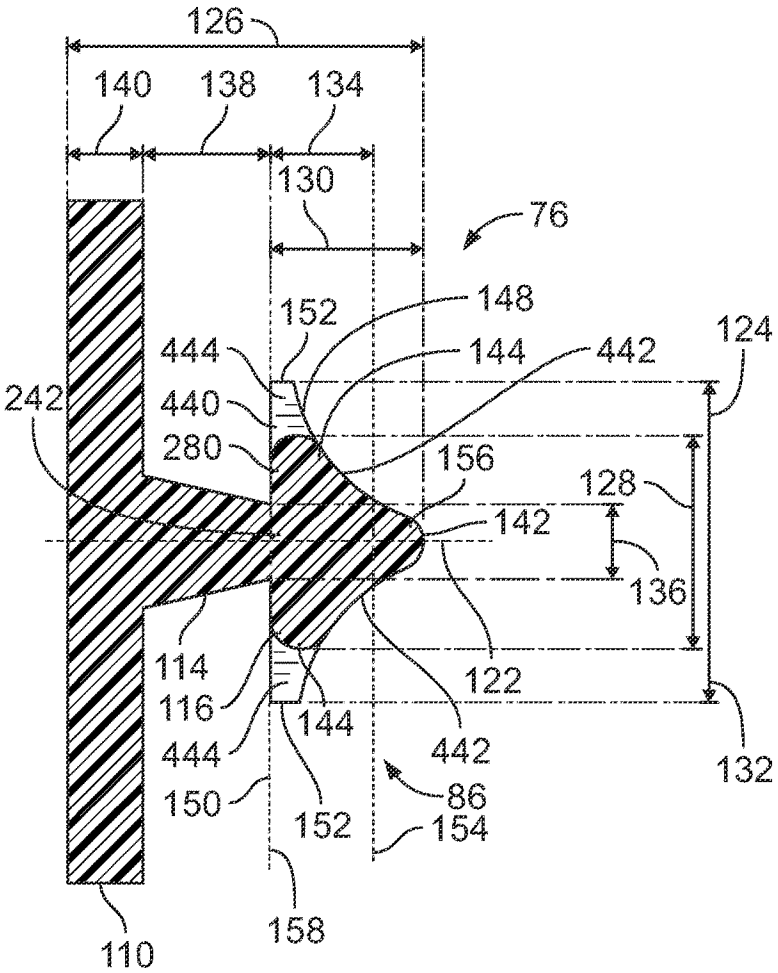
FIG. 10A is a detail view of yet another male closure profile of the closure system of FIGS. 1-4, according to some aspects of the present disclosure.

Referring now to FIG. 10B, the upper arm 172 and the lower arm 174 of the female closure element 88 define a greater degree of curvature at distal ends 186 thereof. Additionally, the inner surfaces 202*a*, 202*b* of the upper and lower arms 172, 174 extend in a substantially more planar manner, i.e., substantially parallel with respect to the centerline 122, than the inner surfaces 202*a*, 202*b* of upper and lower arms 172, 174 shown in FIGS. 5B, 6B, 7B, 8B, and 9B. Additionally, the thickness 196 of the cavity 180 is between about 40% and about 60%, between about 45% and about 55%, or at least about 45% of the thickness 192 of the female closure element 88. The thickness 200 of the opening 188 is between about 30% and about 50%, between about 40% and about 45%, or at least about 40% of the thickness 196 of the cavity 180. The height 194 of the cavity 180 is between about 50% and about 100%, between about 70% and about 80%, or at least about 75% of the height 190 of the female closure element 88. The height 198 of the opening 188 is between about 40% and about 60%, between about 45% and about 50%, or at least about 45% of the height 194 of the cavity 180. In some embodiments, the height 194 of the cavity 180 is between about 75% and about 100%, or about 85% of the height 194 of the cavity 180 illustrated in FIG. 8B. In some embodiments, the thickness 196 of the cavity 180 is between about 70% and about 90%, or about 85% of the thickness 196 of the cavity 180 illustrated in FIG. 8B.

Figure 10C:
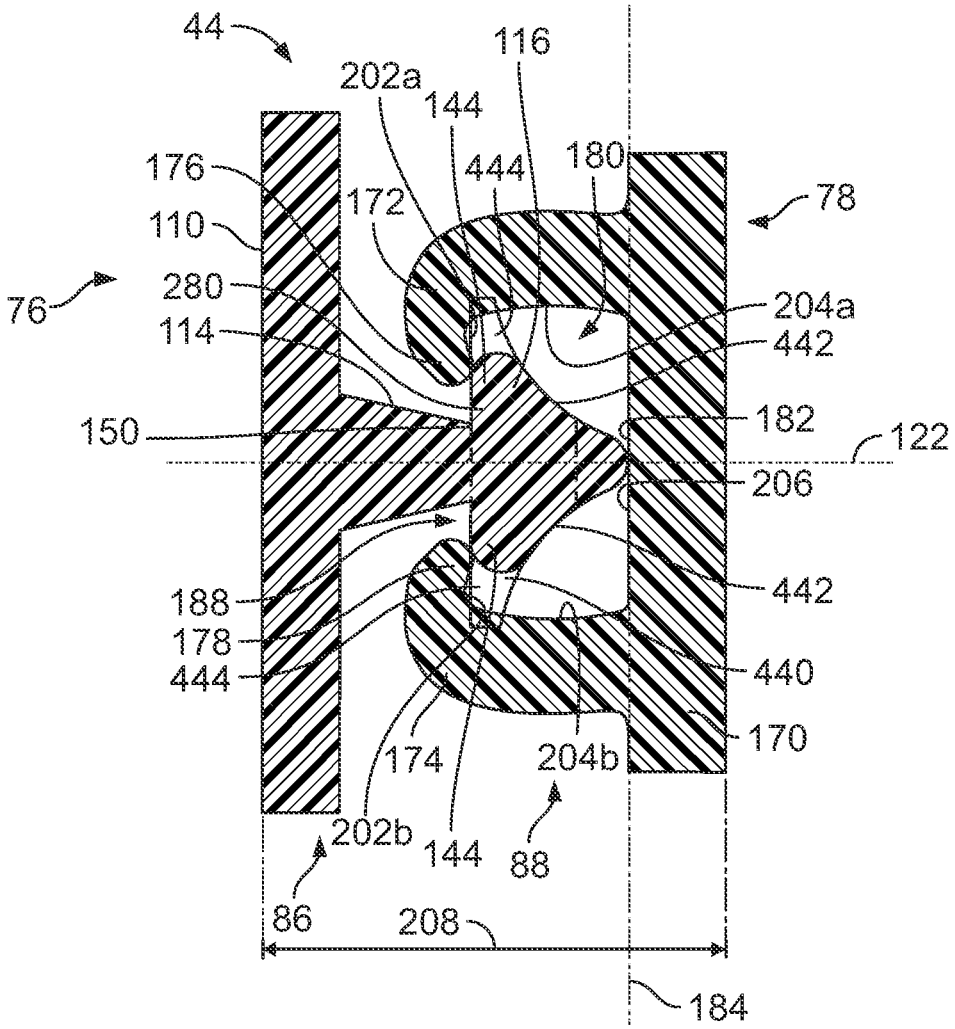
FIG. 10C is a detail view of the male and female closure profiles of FIGS. 10A and 10B in a closed configuration.
Figure 10D:
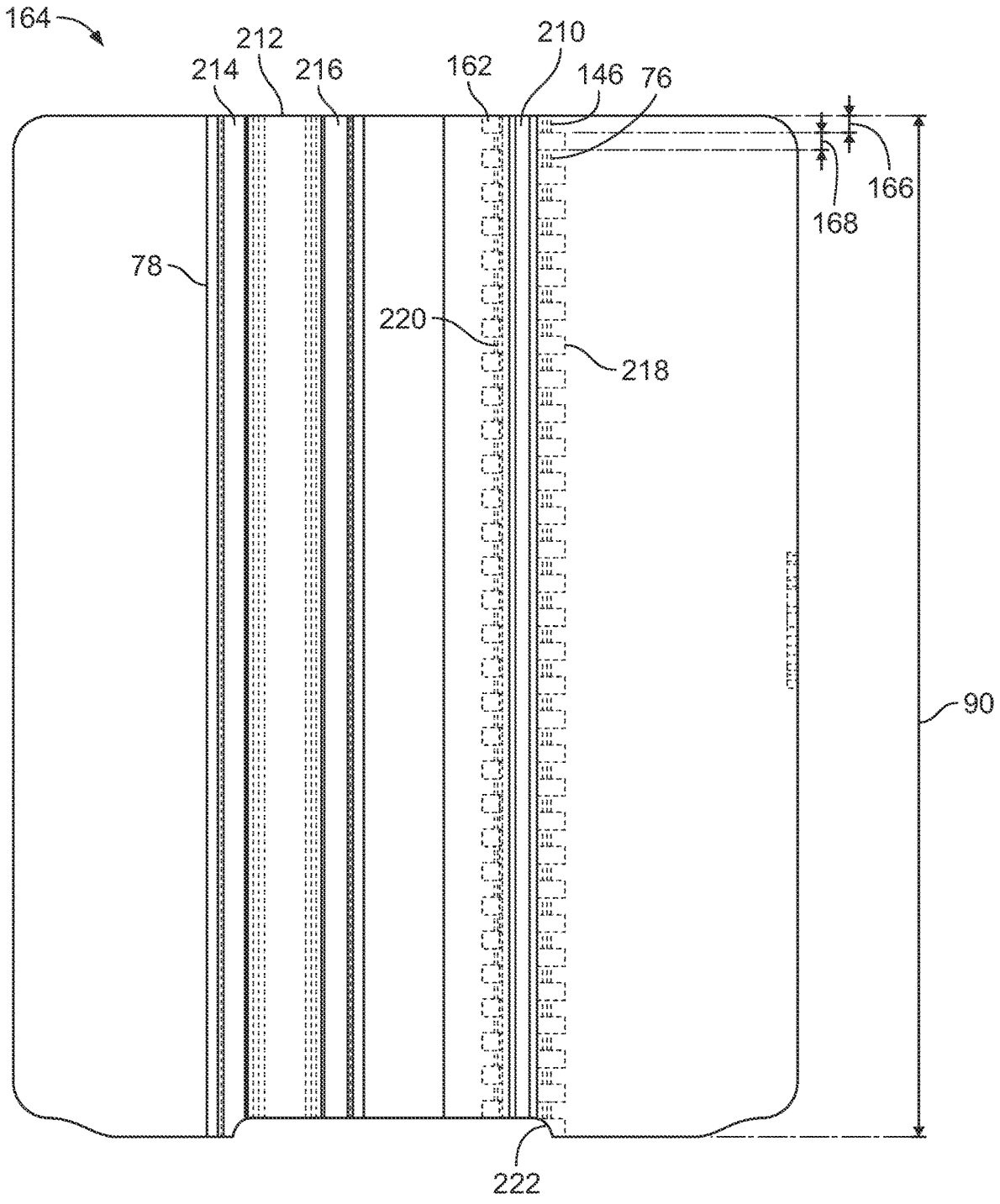
FIG. 10D is a top view of a mold used to manufacture the male and female closure profiles of FIGS. 10A-10C.

Referring now to FIG. 10C, the height 128 of the primary profile 280 is between about 50% and about 75% of the height 194 of the cavity 180, and the thickness 130 of the primary profile 280 is about 100% of the thickness 196 of the cavity 180. In some embodiments, the height 132 of the secondary profile 440 is between about 75% and about 125%, between about 90% and about 110%, between about 95% and about 105%, or at least about 95% of the height 194 of the cavity 180. In some aspects, the thickness 134 of the secondary profile 440 is between about 50% and about 100%, between about 60% and about 80%, between about 70% and about 80%, at least about 65%, or at least about 75% of the thickness 196 of the cavity 180.

The foregoing examples provide an enhanced silicone sealing structure that includes a male closure profile 76 with intermittent interdigitations disposed therealong, which provides unique auditory/tactile feedback during use of the closure system 44. Specifically, the male closure profile 76 includes oversized regions 162 of the head portion 116 that are molded over a continuous primary profile 118, 280 and the oversized regions 162 are spaced apart from one another to define a noncontinuous, enhanced sealing profile which is more desirable for a user. A functional benefit is also achieved in that when the male closure element 86 is inserted into the female closure element 88, as shown in FIGS. 5C, 6C, 7C, 8C, 9C, and 10C, a bending force is created that causes the arms 172, 174 of the female closure element 88 to flex open. The flexure is released after the male closure element 86 has been fully inserted into the cavity 180 female closure profile 78, thereby causing the arms 172, 174 to snap to their original configuration and engage both the oversized regions 162 and the continuous, thin regions 146. During closure of the pouch 40, the flexure caused by the oversized regions 162 and the snap caused by the arms 172, 174 of the female closure element 88 returning to their original configuration provides direct audio and tactile feedback to the user, indicating which portions of the pouch 40 have been closed to form a fluid-tight seal.

This is particularly advantageous for pouches made of silicone or another similar elastomer that are formed as a as a unitary component. Specifically, elastomeric pouches such as those described herein are formed by an entirely different process than conventionally used thermoplastic pouches and are thus subject to substantially different design challenges than those of thermoplastic pouches. For example, the closure mechanisms of elastomeric pouches are typically much larger, thicker, and more resilient than those used for conventional thermoplastic pouches. As such, traditionally used techniques, such as post-manufacture deformation, are not effective when manufacturing elastomeric closure mechanisms with enhanced audio/tactile feedback characteristics. LIM offers several advantages over post-manufacture deformation techniques that are traditionally used to manufacture thermoplastic bags. In particular, LIM allows for the profiles of the elastomeric closure mechanism to be precisely molded while accommodating the large sizes thereof. Additionally, LIM manufacturing simplifies the manufacturing process since all components of the elastomeric bag are formed together in a single step, including the improved profiles of the male closure element 86, which provides enhanced auditory/tactile feedback.

Therefore, the subject technology provides a further benefit in that it allows for precise closure profiles to be manufactured, which enhance audio/tactile feedback. Moreover, the design of the male closure element 86 to include a continuous, primary profile and an oversized, secondary profile that is formed over the primary profile is a significant advancement since it provides a fluid-tight seal and unique auditory/tactile feedback. The continuous profile maintains the fluid-tight seal along the length of the closure element, and the oversized, non-continuous profile provides unique tactile/auditory feedback as well as increasing the retaining force of the female closure element on the male closure element. Thus, these features, alone or in combination, achieve an enhanced closure system that provides useful auditory/tactile feedback to a user, and provides for an enhanced seal.

Additionally, as would be appreciated by those of ordinary skill in the pertinent art, the subject technology is applicable to any type of bag, pouch, package, and various other storage containers, e.g., snack, sandwich, quart, and gallon size bags. The subject technology is also adaptable to bags having double zipper, or multiple zipper, or other type of closure mechanisms. Furthermore, it is contemplated that the subject technology disclosed herein could be applied to a number of different closure systems to enhance aspects of their function, such as those disclosed in U.S. Pat. No. 9,371,153 and/or U.S. Patent Pub. No. 2022/0402658, which are incorporated by reference herein in their entirety.

INDUSTRIAL APPLICABILITY

The closure systems as described herein advantageously provide for containers or pouches that are re-usable and include sealing systems having enhanced sealing capabilities while being able to seal and unseal for an end user.

Numerous modifications will be apparent to those skilled in the art in view of the foregoing description. Accordingly, this description is to be construed as illustrative only and is presented for the purpose of enabling those skilled in the art to make and use the disclosure. The exclusive rights to all modifications which come within the scope of the application are reserved. All patents and publications are incorporated by reference.

We claim:

1. A container or pouch made entirely from an elastomer, comprising:

a body, comprising:

a front wall; and a rear wall that is connected to the front wall along a peripheral edge; and a closure system, comprising:

a front side having a male closure profile that includes a male closure element; and a rear side having a female closure profile that includes a female closure element and defining a cavity, wherein a centerline extends through the cavity such that the female closure element is symmetrical about the centerline, wherein the male closure element includes a head portion that has a continuous, primary profile and a non-continuous, secondary profile that extends from the primary profile, wherein a height of the secondary profile measured in a direction that is perpendicular to the centerline is greater than a height of the primary profile measured in a direction that is perpendicular to the centerline, and wherein the secondary profile comprises an outward face that is defined by a first vertical plane that extends in a direction perpendicular to the centerline, an inward face that is defined by a second vertical plane that is parallel to the first vertical plane, and side faces that extend between the outward face and the inward face.

2. The container or pouch of claim 1, wherein the female closure element further comprises a base portion, an upper arm that extends outward from the base portion, and a lower arm that extends outward with respect to the base portion, and wherein an opening into the cavity of the female closure element is defined between the upper arm and the lower arm.

3. The container or pouch of claim 2, wherein the upper arm defines an upper hook portion at a distal free end thereof and the lower arm defines a lower hook portion at a distal free end thereof, and wherein the opening is further defined between the upper hook portion and the lower hook portion.

4. The container or pouch of claim 1, wherein the male closure element further comprises a base region and a stem that extends between the base region and the head portion, and wherein the primary profile, the secondary profile, the stem, and the base region are molded together with the front wall to form a unitary component.

5. The container or pouch of claim 1, wherein the male closure element further includes a base region and a stem that extends from the base region to the head portion, and wherein a height of the stem measured in a direction that is perpendicular to the centerline is between 10% and 50% of a height of the female closure element measured in a direction that is perpendicular to the centerline.

6. The container or pouch of claim 1, wherein the height of the secondary profile is greater than a height of the cavity measured in a direction perpendicular to the centerline.

7. The container or pouch of claim 1, wherein the primary profile defines thin regions of the male closure element and the secondary profile defines oversized regions of the male closure element, and wherein a length of a single oversized region of the male closure element measured in a direction parallel to a longitudinal plane that extends through the peripheral edge is between 1% and 10% of a length of the male closure element measured in a direction parallel to the longitudinal plane.

8. The container or pouch of claim 1, wherein alternating portions of the secondary profile are uniformly spaced from one another by alternating portions of the primary profile.

9. A container or pouch made entirely from an elastomer, comprising:

a body, comprising:

a front wall; and a rear wall that is connected to the front wall along a peripheral edge; and a closure system, comprising:

a front side having a male closure profile that includes a male closure element; and a rear side having a female closure profile that includes a female closure element and defining a cavity, wherein a centerline extends through the cavity such that the female closure element is symmetrical about the centerline, wherein the male closure element includes a head portion that has a continuous, primary profile and a non-continuous, secondary profile that extends from the primary profile, and wherein a height of the secondary profile measured in a direction that is perpendicular to the centerline is greater than a height of the cavity measured in a direction that is perpendicular to the centerline.

10. The container or pouch of claim 9, wherein the secondary profile comprises an outward face that is defined by a first vertical plane that extends in a direction perpendicular to the centerline, an inward face that is defined by a second vertical plane that is parallel to the first vertical plane, and side faces that extend between the outward face and the inward face.

11. The container or pouch of claim 9, wherein the female closure element further comprises a base portion, an upper arm that extends outward from the base portion, and a lower arm that extends outward with respect to the base portion, and wherein an opening into the cavity of the female closure element is defined between the upper arm and the lower arm.

12. The container or pouch of claim 11, wherein the upper arm defines an upper hook portion at a distal free end thereof and the lower arm defines a lower hook portion at a distal free end thereof, and wherein the opening is further defined between the upper hook portion and the lower hook portion.

13. The container or pouch of claim 9, wherein the male closure element further comprises a base region and a stem that extends from the base region to the head portion, and wherein a height of the stem measured in a direction that is perpendicular to the centerline is between 10% and 50% of a height of the female closure element measured in a direction that is perpendicular to the centerline.

14. The container or pouch of claim 9, wherein the height of the secondary profile is greater than a height of the primary profile measured in a direction that is perpendicular to the centerline.

15. The container or pouch of claim 9, wherein the primary profile defines thin regions of the male closure element and the secondary profile defines oversized regions of the male closure element, and wherein a length of a single oversized region of the male closure element measured in a direction parallel to a longitudinal plane that extends through the peripheral edge is between 1% and 10% of a length of the male closure element measured in a direction parallel to the longitudinal plane.

16. The container or pouch of claim 9, wherein alternating portions of the secondary profile are uniformly spaced from one another by alternating portions of the primary profile.

17. A container or pouch made entirely from an elastomer, comprising:

a body, comprising:

a front wall; and a rear wall that is connected to the front wall along a peripheral edge; and a closure system, comprising:

a front side having a male closure profile that includes a male closure element; and a rear side having a female closure profile that includes a female closure element and defining a cavity and an opening, wherein a longitudinal plane extends through the peripheral edge and a centerline extends through the cavity and the opening such that the female closure element is symmetrical about the centerline, wherein the male closure element includes a head portion that has a continuous, primary profile that defines thin regions of the male closure element and a non-continuous, secondary profile that extends from the primary profile and defines oversized regions of the male closure element, wherein a length of a single thin region is measured in a direction parallel to the longitudinal plane and is between 1% and 10% of a length of the male closure element measured in a direction parallel to the longitudinal plane, wherein a length of a single oversized region of the male closure element is measured in a direction parallel to the longitudinal plane and is between 1% and 10% of the length of the male closure element, and wherein a height of the secondary profile measured in a direction perpendicular to the centerline is greater than a height of the cavity measured in a direction perpendicular to the centerline.

18. The container or pouch of claim 17, wherein the secondary profile comprises an outward face that is defined by a first vertical plane that extends in a direction perpendicular to the centerline, an inward face that is defined by a second vertical plane that is parallel to the first vertical plane, and side faces that extend between the outward face and the inward face.

19. The container or pouch of claim 17, wherein the female closure element further comprises a base portion, an upper arm that extends outward from the base portion, and a lower arm that extends outward with respect to the base portion, and wherein the opening of the female closure element is defined between the upper arm and the lower arm.

20. The container or pouch of claim 17, wherein the male closure element further comprises a base region and a stem that extends from the base region to the head portion, and wherein a height of the stem measured in a direction that is perpendicular to the centerline is between 10% and 50% of a height of the female closure element measured in a direction that is perpendicular to the centerline.

21. The container or pouch of claim 17, wherein alternating portions of the secondary profile are uniformly spaced from one another by alternating portions of the primary profile.

* * * * *